US006202686B1

(12) United States Patent
Pitsch et al.

(10) Patent No.: US 6,202,686 B1
(45) Date of Patent: Mar. 20, 2001

(54) FAUCET WITH ONE-PIECE MANIFOLD

(75) Inventors: Walter Pitsch, Franklin Park, NJ (US); Juergen Mueller, Reil (DE)

(73) Assignee: American Standard Inc., Piscataway, NJ (US)

( * ) Notice: Subject to any disclaimer, the term of this patent is extended or adjusted under 35 U.S.C. 154(b) by 0 days.

(21) Appl. No.: 09/240,390

(22) Filed: Jan. 29, 1999

(51) Int. Cl.[7] ..... E03C 1/04

(52) U.S. Cl. ..... 137/597; 4/677; 137/359; 137/615; 137/625.17; 137/801

(58) Field of Search ..... 4/677; 137/359, 137/615, 625.17, 801, 597, 119.04

(56) References Cited

U.S. PATENT DOCUMENTS

| | | | | |
|---|---|---|---|---|
| 2,314,071 | * | 3/1943 | Bucknell et al. | 137/119.04 |
| 2,348,238 | | 5/1944 | Beeke et al. . | |
| 2,830,618 | * | 4/1958 | Mitchell | 137/606 X |
| 3,010,474 | | 11/1961 | Moen . | |
| 3,035,612 | | 5/1962 | Lyon . | |
| 3,056,418 | * | 10/1962 | Adams et al. | 137/119.04 |
| 3,166,097 | * | 1/1965 | Hinderer et al. | 137/625.17 |
| 3,590,876 | | 7/1971 | Young . | |
| 3,875,960 | * | 4/1975 | Miller | 137/119.04 |
| 4,008,732 | * | 2/1977 | Fichter et al. | 137/119.04 |
| 4,290,445 | | 9/1981 | Turner . | |
| 4,301,972 | * | 11/1981 | Rudelick | 137/625.17 |
| 4,314,673 | * | 2/1982 | Rudelick | 137/625.17 X |
| 4,356,574 | | 11/1982 | Johnson . | |
| 4,387,738 | | 6/1983 | Bisonaya et al. . | |
| 4,513,769 | | 4/1985 | Purcell . | |
| 4,649,958 | | 3/1987 | Purcell . | |
| 4,763,693 | * | 8/1988 | Valley | 137/801 |
| 4,798,221 | * | 1/1989 | Crawford | 137/119.04 |
| 4,934,402 | * | 6/1990 | Tarnay et al. | 137/119.04 |
| 5,131,428 | | 7/1992 | Bory . | |
| 5,165,121 | | 11/1992 | McTargett et al. . | |
| 5,301,715 | * | 4/1994 | Becker | 137/801 X |
| 5,368,071 | | 11/1994 | Hsieh . | |
| 5,375,272 | * | 12/1994 | Mikol | 137/359 X |
| 5,558,128 | | 9/1996 | Pawelzik et al. . | |
| 5,566,707 | | 10/1996 | Ching et al. . | |
| 5,595,216 | | 1/1997 | Pilolla . | |
| 5,642,755 | | 7/1997 | Mark et al. . | |
| 5,752,541 | * | 5/1998 | Gonzalez | 137/119.04 |
| 5,778,921 | * | 7/1998 | Ko | 137/119.04 |
| 5,881,754 | * | 3/1999 | Wei | 137/119.04 |

* cited by examiner

*Primary Examiner*—Gerald A. Michalsky

(57) ABSTRACT

The present invention relates to a faucet which includes a one-piece manifold body and a swivel spout pivotably mounted on the body. The body preferably has first and second leg portions for accepting fluid flow therethrough. The faucet may also preferably include an escutcheon coupled to the body, a cartridge coupled to the body, and a retainer ring interposed between the cartridge and the body. In one preferred embodiment, the faucet may include an auxiliary outlet mechanism which may include a diverter valve disposed in the body, as well as a hand spray coupled to the body and in fluid communication with the diverter valve.

19 Claims, 20 Drawing Sheets

FAUCET WITH ONE-PIECE MANIFOLD

FIELD OF THE INVENTION

The present invention relates to faucets generally and, more particularly, but not by way of limitation, to a novel swivel spout faucet.

BACKGROUND OF THE INVENTION

The present invention concerns faucets in general, and in particular faucets having a swivel spout, such as those typically installed in kitchen sinks.

The installation and maintenance of known, conventional faucets is generally time-consuming and difficult because many of the fastening members must be attached and turned from below a sink deck, at times requiring the plumbing contractor installing or maintaining the fixture to work in extremely cramped conditions. A preferred approach to these difficulties is to insert a fixture into an opening or openings in a sink deck and install the fixture substantially from above the sink deck, except for nut-tightening from below the deck.

A principal object of the present invention is to provide a faucet construction which is easy to install and maintain. Another object is to provide a faucet having an internal waterway formed from a single manifold member which also serves as a structural mount. Yet another object of the present invention is to provide a faucet construction which allows for easy maintenance of most serviceable parts from above the sink deck.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a particular embodiment, a faucet with a one-piece manifold body.

The present invention relates to a faucet comprising a one-piece manifold body and a swivel spout pivotably mounted on the body. The body preferably comprises first and second leg portions for accepting fluid flow therethrough. The faucet may preferably include sink deck mounting nuts for securing the first and second leg portions. The faucet may also preferably include an escutcheon coupled to the body, a cartridge coupled to the body, and a retainer ring interposed between the cartridge and the body. In one preferred embodiment, the faucet may include a diverter valve disposed in the body, as well as a hand spray coupled to the body.

In another embodiment, the present invention relates to a faucet which comprises a one-piece manifold body and a swivel spout. The one-piece manifold body preferably has first and second inlet passages and at least one outlet passage, including a main outlet passage which opens to the exterior of the body at a main exit. The swivel spout preferably includes a base sleeve provided with an outlet opening and pivotably mounted on the body over the main exit, and a conduit depending from the base sleeve and in fluid communication with the outlet opening. Thus, fluid may flow out of the main outlet passage and through the base sleeve and the conduit.

The at least one outlet passage may further include an auxiliary outlet passage disposed in the body which opens to the exterior of the body at an auxiliary exit. The faucet may also include a diverter valve disposed in the body for selectively directing flow either to the main exit or the auxiliary exit.

The faucet may further comprise a cartridge mounted to the body, the cartridge being provided with first and second inlet openings in fluid communication with respective first and second inlet passages, and the cartridge also being provided with an outlet opening in fluid communication with the entrance of the main outlet passage. A retainer ring may be advantageously mounted between the body and the cartridge.

The body may further preferably comprise first and second shank portions, the first shank portion having a bore which forms at least part of the first inlet passage, and the second shank portion having a bore which forms at least part of the second inlet passage.

The faucet may also preferably include sealing means disposed between the base sleeve and the body for preventing leakage.

The body preferably comprises a generally cylindrical outer wall around which the base sleeve is mounted, thereby allowing the base sleeve to swivel therearound.

The faucet may also include an escutcheon, and the body may preferably include an escutcheon mounting portion for allowing the attachment of the escutcheon directly to the body.

In yet another embodiment, the present invention relates to a fitting comprising a one-piece faucet body for use with a first fluid conduit, a second fluid conduit, and a faucet cartridge having two inlet openings and an outlet opening. The faucet body comprises a first hollow leg for connection with the first fluid conduit, a second hollow leg for connection with the second fluid conduit, and a boss. The boss has a mounting surface adapted for coupling to the cartridge, a first chamber which is open to the interior of the first hollow leg and to one of the inlet openings of the cartridge, a second chamber which is open to the interior of the second hollow leg and to the other inlet opening of the cartridge, and an outlet passage fluidly connecting the outlet opening of the cartridge with the exterior of the faucet body at a main exit which is remote from the mounting surface.

The fitting may further comprise a swivel spout having a sleeve base and an outlet conduit, the sleeve base having an outlet opening to the outlet conduit, the sleeve base being pivotably mounted around the boss and over the exit of the outlet passage in the boss. At least a part of the exterior of the boss which is surrounded by the sleeve base is preferably provided with a recess for allowing fluid which flows from the exit of the outlet passage in the boss to travel between the exterior of the boss and the sleeve base, thereby defining a primary outlet flow path whereby fluid may flow out of the outlet passage, around the exterior of the boss, through the outlet opening of the sleeve base and into the outlet conduit.

The fitting may also preferably include sealing means disposed between the boss and the sleeve base for sealing at least part of the primary outlet flow path.

In a particular manifestation, the outlet passage in the boss may further comprise an auxiliary branch for delivering flow to the exterior of the faucet body at an auxiliary exit located away from the main exit of the outlet passage. The fitting may then include means for selectively diverting fluid flow into the auxiliary branch. The means for selectively diverting fluid flow may comprise a diverter valve. The faucet may comprise a handspray connected to the auxiliary branch.

The fitting may also further comprise an escutcheon for covering at least a part of the faucet body, and mounting means disposed on the faucet body for attaching the escutcheon directly to the faucet body.

In still another embodiment, the present invention relates to a one-piece faucet body for connection with a first fluid conduit, a second fluid conduit, and a faucet cartridge having two inlet openings and an outlet opening. The faucet body comprises a first hollow leg portion for connection with the first fluid conduit, a second hollow leg portion for connection with the second fluid conduit, and a cylindrical portion. The cylindrical portion has a mounting surface adapted for coupling to the cartridge, a first chamber fluidly connected to the interior of the first hollow leg portion and to one of the inlet openings of the cartridge, a second chamber fluidly connected to the interior of the second hollow leg portion and to the other inlet opening of the cartridge, and an outlet passage fluidly connecting the outlet opening of the cartridge with the exterior of the faucet body away from the cartridge, wherein the first and second hollow leg portions depend from the cylindrical portion.

The exterior of the cylindrical portion preferably has a recess for allowing fluid which exits from the outlet passage to flow around the exterior of the cylindrical portion.

The one-piece faucet body may preferably include escutcheon mounting means disposed on at least one of the legs, whereby an escutcheon may be mounted directly to the faucet body. In a particular embodiment, the escutcheon mounting means is disposed on each of the legs.

The outlet passage may include an auxiliary branch for delivering flow to the exterior of the faucet body, i.e. away from the exit of the outlet passage.

The cylindrical portion of the one-piece faucet body may advantageously be adapted to accommodate a diverter valve within the outlet passage.

In a particular manifestation, the cylindrical portion has an interior cavity and an interior wall which separates the interior cavity into first and second inlet chambers, wherein first and second openings in a base of the cylindrical portion are positioned in fluid communication with respective first and second inlet chambers, and wherein first and second openings in a distal end are positioned in fluid communication with respective first and second inlet chambers. An outlet path is disposed between the base and distal end of the faucet body and is in fluid communication with a third opening or outlet opening in the distal end. The exit of the outlet path is provided in the boss portion, which may also have an auxiliary exit opening.

The faucet preferably includes a retainer ring which comprises an annular wall, which has a top end, a bottom end, an inner surface, and an outer surface; and at least one flange extending inwardly from the inner surface and bisecting the annular wall, thereby defining a downwardly facing cup portion and an upwardly facing cup portion, wherein the downwardly facing cup portion is adapted to engage the cartridge and the upwardly facing cup portion is adapted to engage the one-piece manifold body, whereby the at least one flange is sandwiched between the cartridge and the body. The at least one flange preferably comprises at least one opening, and in at least one preferred embodiment the at least one opening comprises at least one cutout. The outer surface of the annular wall preferably comprises at least one raised portion, and at least one end of the at least one raised portion is preferably contoured. The lower end of the annular wall further preferably comprises a shoulder adapted to engage the base sleeve of the swivel spout.

BRIEF DESCRIPTION OF THE DRAWINGS

Understanding of the present invention and the various aspects thereof will be facilitated by reference to the accompanying drawing figures, submitted for purposes of illustration only and not intended to limit the scope of the invention, in which.

DETAILED DESCRIPTION OF THE PREFERRED EMBODIMENTS

Figure 1:
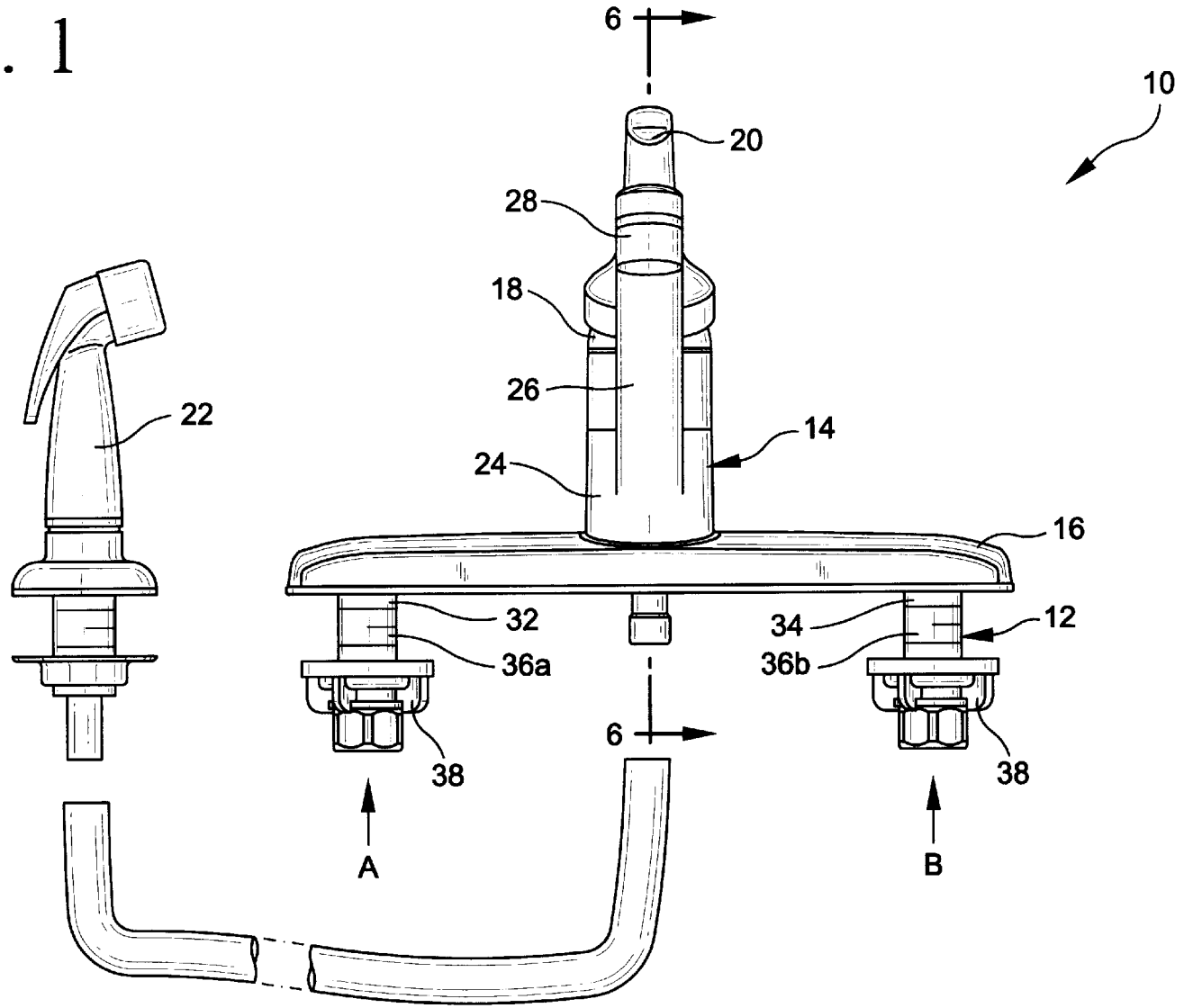
FIG. 1 is a front elevational view of a faucet with a handspray attachment, in accordance with a first preferred embodiment of the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may also be seen on other views.

Figure 4:
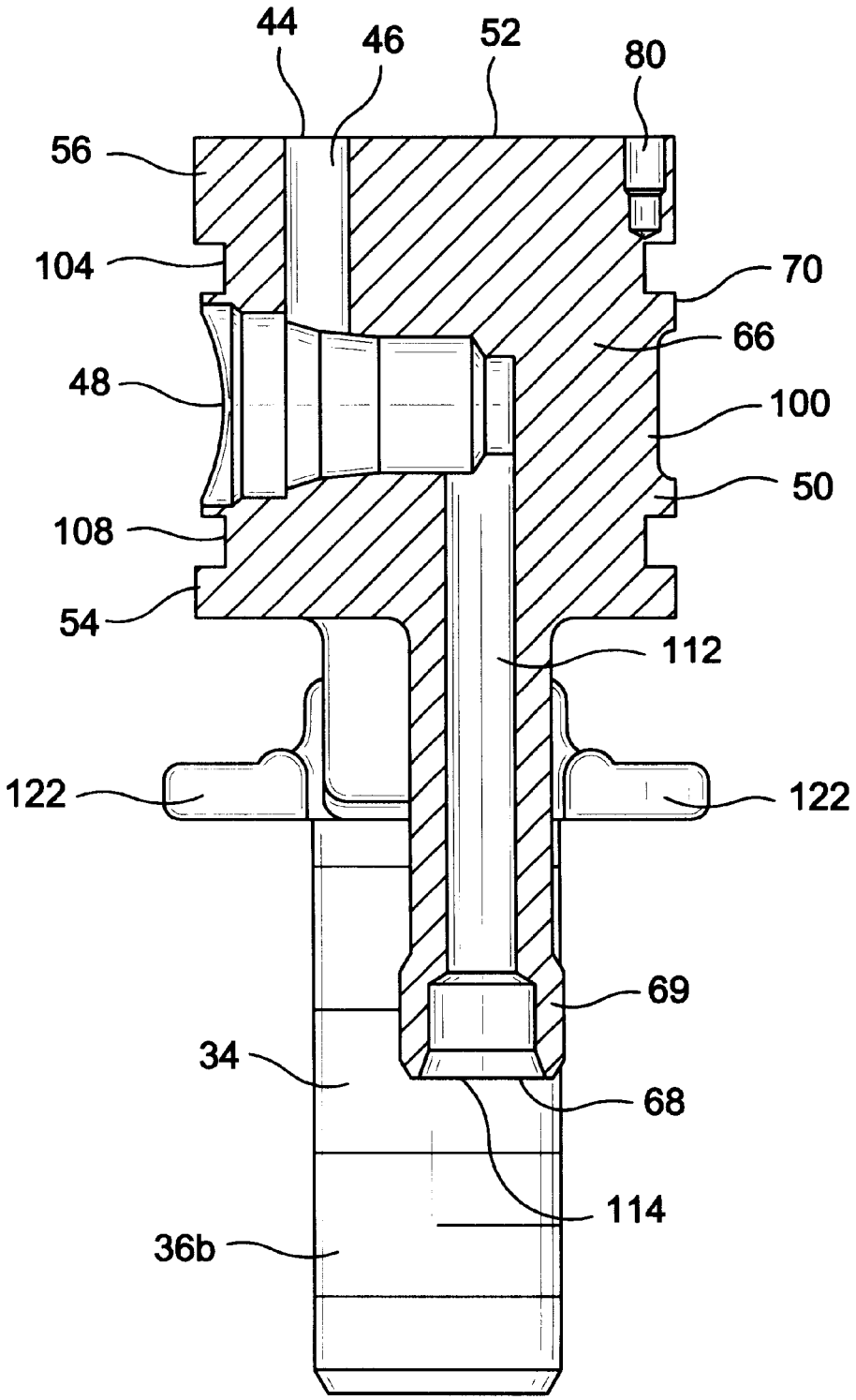
FIG. 4 is a side elevational cross-sectional view of the one-piece manifold body of FIG. 2 taken along line 4—4.
Figure 5:
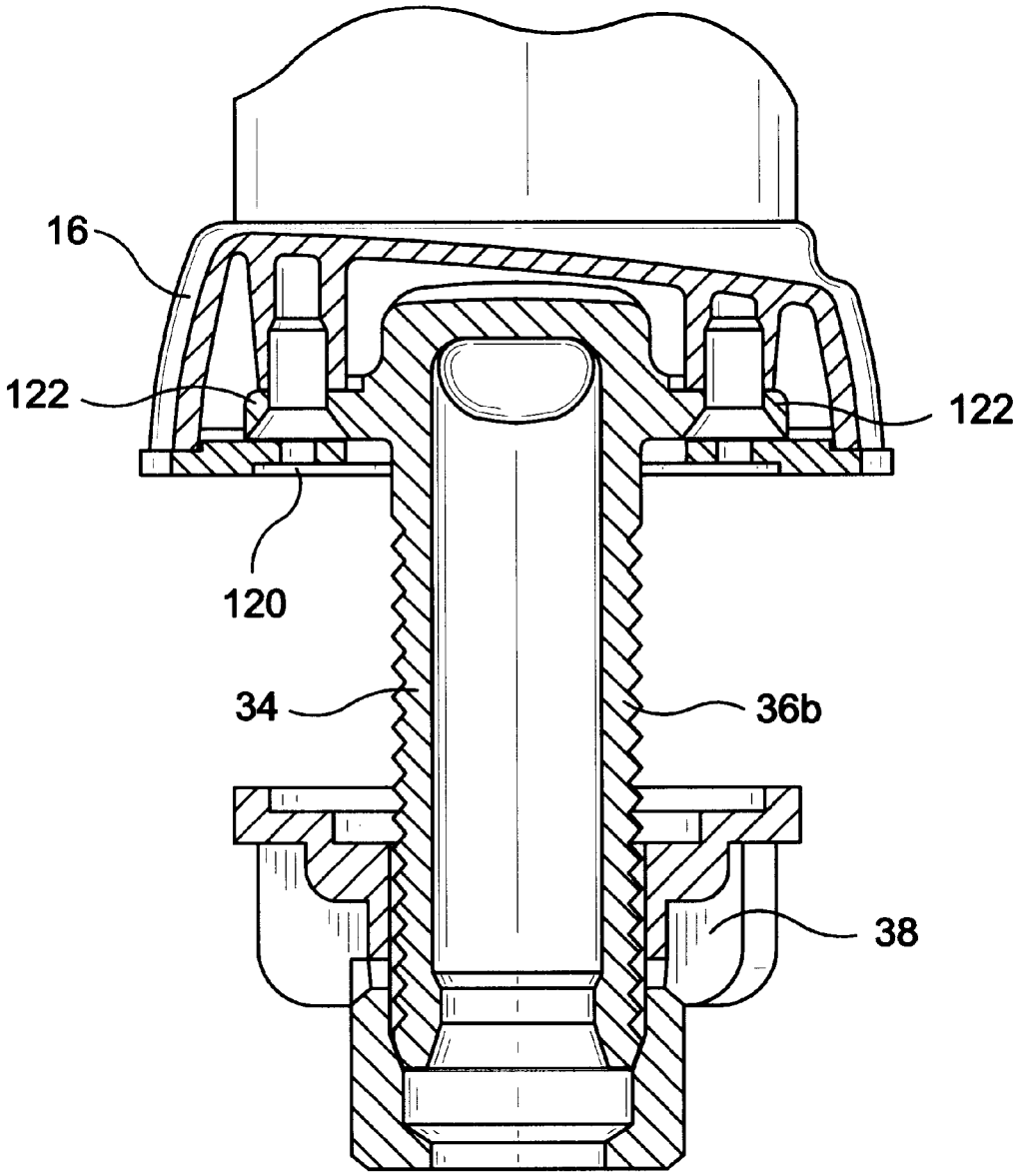
FIG. 5 is a side elevational cross-sectional view of the one-piece manifold body of FIG. 2 taken along line 5—5.
Figure 6:
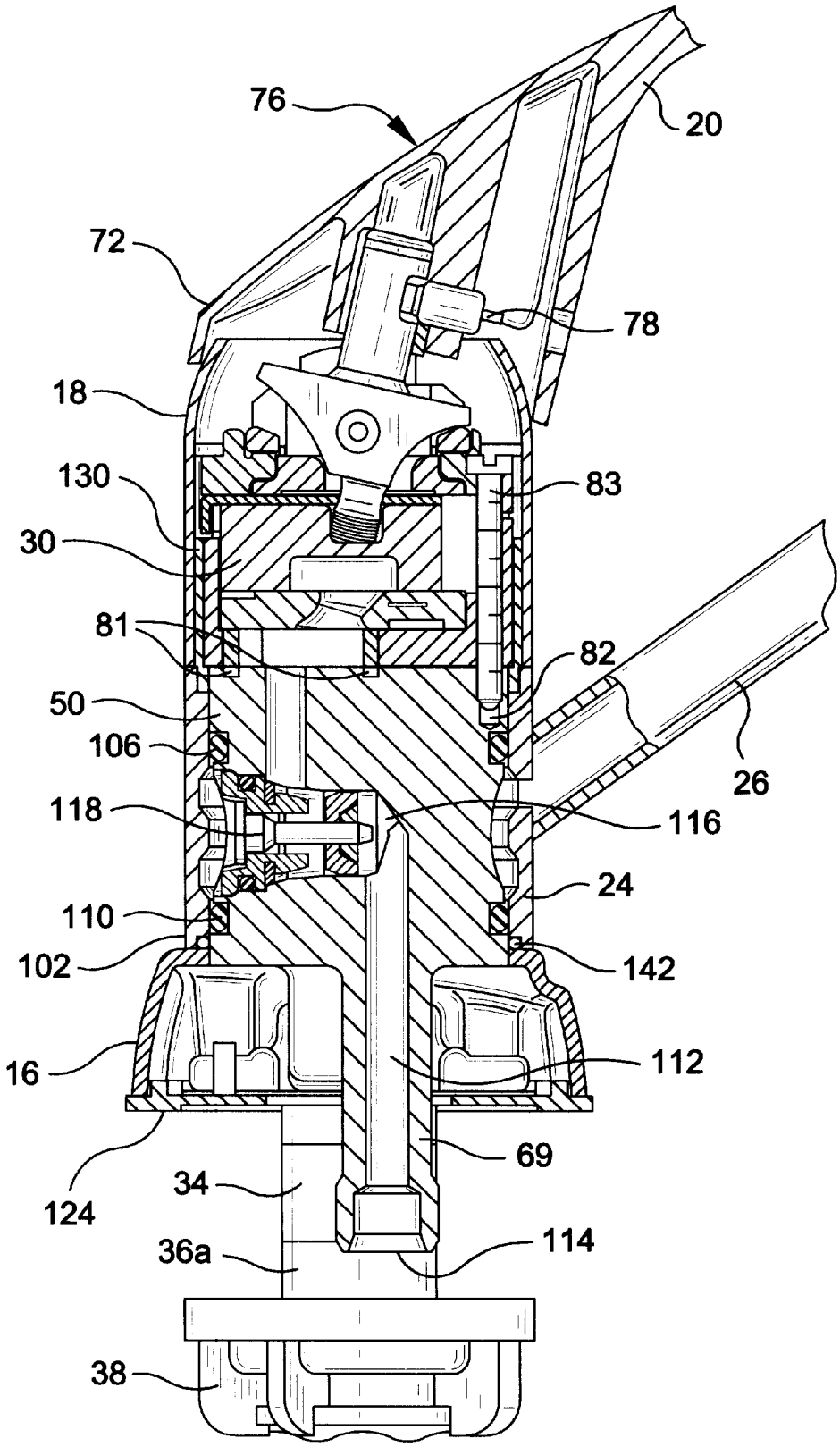
FIG. 6 is a partial side elevational cross-sectional view of the faucet of FIG. 1 taken along line 6—6.

Referring initially to FIGS. 1–7, one preferred embodiment of the present invention relates to a faucet 10 comprising a one-piece manifold body 12 and a swivel spout 14. The faucet fixture 10 shown in FIG. 1 includes an escutcheon 16, a dome cover 18, a handle 20, and a handspray 22. The escutcheon 16 is preferably fixed to the unitarily constructed internal waterway or one-piece body 12 of the faucet 10 as described more fully in detail below. The swivel spout 14 has a base sleeve 24 and a conduit 26. An aerator 28 is typically optionally fitted to the distal end of the conduit 26. As seen in FIG. 6, the faucet 10 also comprises a cartridge 30. The cartridge 30 is typically provided with first and second inlet openings and an outlet opening.

As seen in FIGS. 1–5, the one-piece faucet body 12 has a first hollow leg portion 32 and a second hollow leg portion 34. The first leg 32 can be connected to a first fluid conduit, and the second leg 34 can be connected to a second fluid conduit, wherein the conduit may be a pipe, a tube, a hose, or the like. A first inlet passage begins at the entrance to the first leg portion 32 as indicated by arrow A in FIG. 1, and a second inlet passage begins at the entrance to the second leg portion 34 as indicated by arrow B. In a typical application, the first fluid conduit could be a cold water supply and the second fluid conduit could be a hot water supply, or vice-versa. The first and second hollow legs 32, 34 each preferably include a hollow shank section 36*a*, 36*b* which enables a direct physical connection to the fluid source conduits. Thus, the first shank section 36*a* has a bore which forms at least part of the first inlet passage, and the second shank section 36*b* has a bore which forms at least part of the second inlet passage. The shank sections 36*a*, 36*b* may be further adapted to facilitate connection with the supply conduit, such as by threading. Thus, the body 12 can be mounted directly to a supporting or rigid supply conduit, thereby obviating another separate physical connection between the body and the supporting structure as would be found in existing faucets.

For example, the first and second legs 32, 34 may be connected to a cold water supply pipe and a hot water supply pipe, respectively. The shank portions 36*a*, 36*b* of the first and second legs 32, 34 may be threaded, e.g. to mate with a threaded fastener which may be disposed on each shank section 36*a*, 36*b* and/or on the respective supply pipe. Cold water may then pass through the first shank section 36*a* on the first leg portion 32, and hot water may pass through the second shank section 36*b* on the second leg portion 34. The body 12 as well as the entire faucet 10 can be mounted to the supply pipes and sink deck.

FIG. 1 shows the one-piece body 12 in position to be fixed to a sink deck by mounting nuts 38 which engage an external surface of the first and second legs 32, 34.

In general, it is noted that known single handle fixtures typically include copper tubing waterway inlets brazed to a separate manifold unit, and must often provide separate fixation bolts in the escutcheon to secure the fixture to the sink deck with mounting nuts. On the other hand, the present invention is much easier to install and is much more rugged because only the one-piece body 12 is attached through the deck to the underside of the sink. Furthermore, most faucet maintenance of the present invention can be accomplished from above the sink deck by simply removing components such as the handle, cartridge, cartridge cover, retainer ring and spout, from above. The escutcheon is not required to be removed for most maintenance of the faucet.

Thus, when assembled, the faucet fixture 10 of the present invention is supported on a sink deck. However, unlike conventional fixtures, the unitary, one-piece waterway 12 is the only component directly secured to the sink deck.

Figure 3:
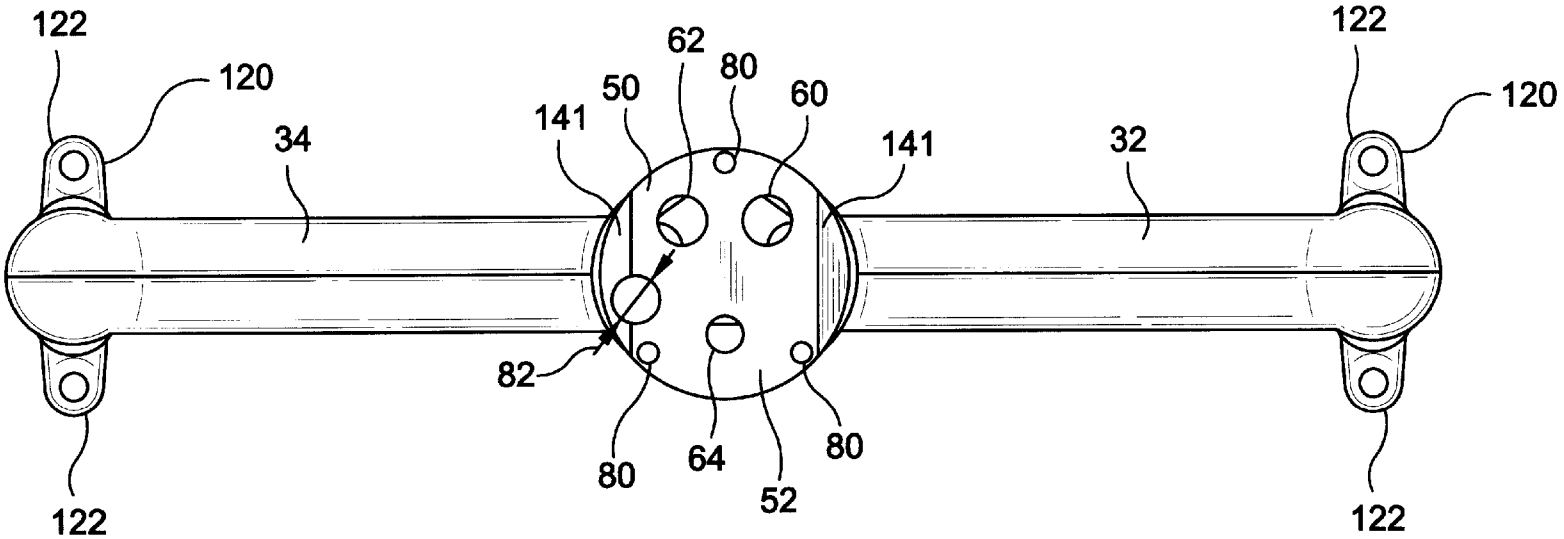
FIG. 3 is a top view of the one-piece manifold body of FIG. 2.

As best seen in FIG. 4, the one-piece manifold body 12 has first and second inlet passages and an outlet means 44 having at least one outlet passage, including a main outlet passage 46 which opens to the exterior of the body 12 at a main exit 48. Referring to FIGS. 2–5, the one-piece body 12 includes a cylindrical boss 50 having a mounting surface 52 adapted for coupling to the cartridge 30. The one-piece body 12 also has a first chamber which is open to the interior of the first hollow leg 32 and to one of the inlet openings of the cartridge 30 thereby providing fluid communication therebetween. The one-piece manifold body 12 also has a second chamber which is open to the interior of the second hollow leg 34 and to the other inlet opening of the cartridge 30 thereby providing fluid communication therebetween.

The outlet means 44, which includes the main outlet passage 46, is provided in the one-piece body 12 for fluidly connecting the outlet opening of the cartridge 30 with the exterior of the faucet body 12 at a main exit 48 which is remote from the mounting surface 52.

Figure 2:
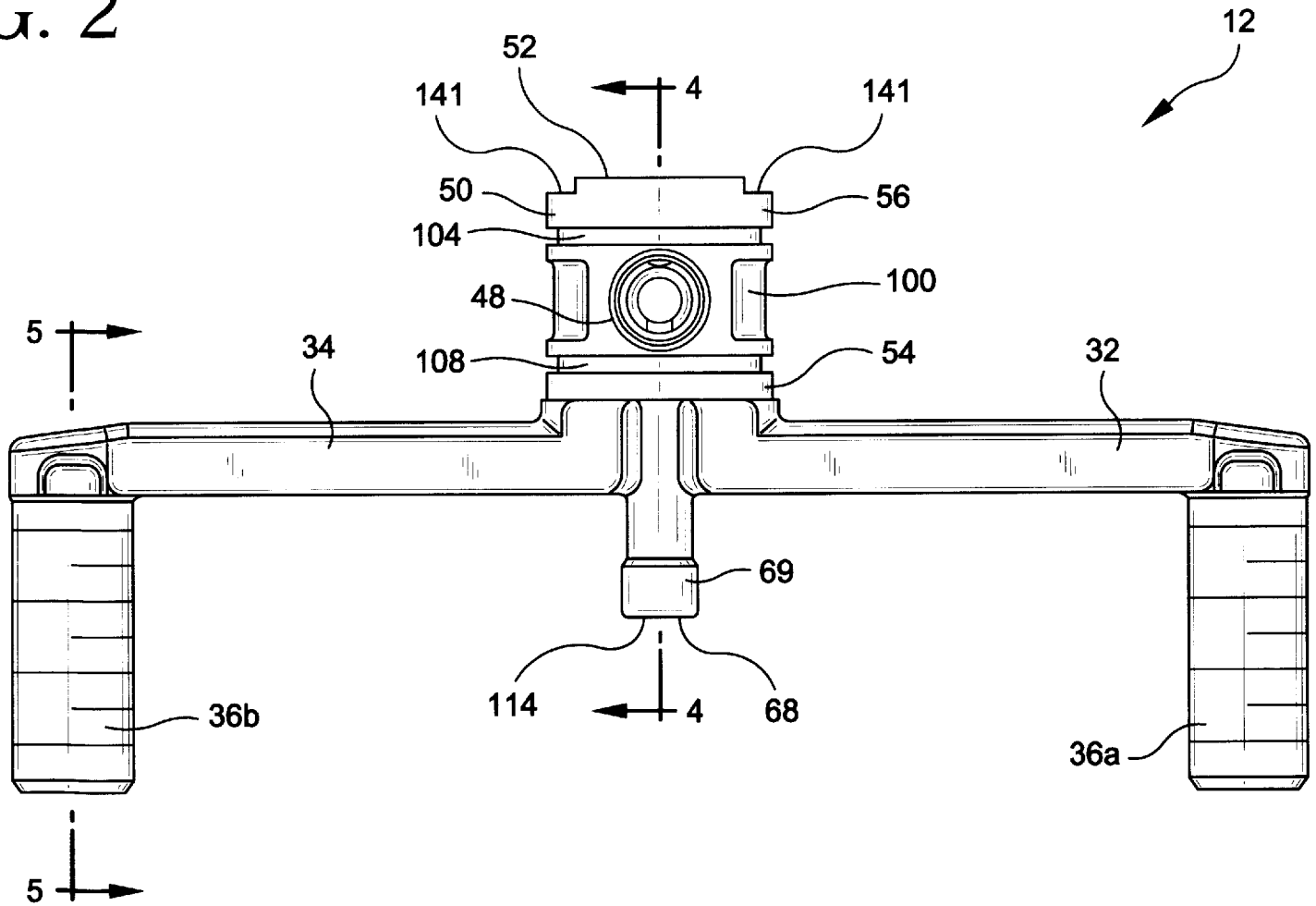
FIG. 2 is a rear elevational view of a one-piece manifold body, in accordance with the embodiment of the present invention depicted in FIG. 1.

As best seen in FIGS. 2 & 3, the boss 50 has a base section 54, which has first and second inlet passage inlet-openings, and a distal section 56, which has first and second inlet passage outlet-openings 60, 62. The distal section 56 also has a third opening or an outlet passage inlet-opening 64.

In the embodiment illustrated in FIG. 4, the boss 50 has an interior wall 66 which separates an interior cavity into the first and second inlet chambers. The first and second inlet passage inlet-openings in the base are positioned in fluid communication with the respective first and second inlet chambers, and the first and second inlet passage outlet-openings 62, 64 in the distal end 56 are likewise positioned in fluid communication with respective first and second inlet chambers. The outlet means 44 is disposed between the base 54 and distal end 56 and intersects the interior wall 66.

As shown in FIGS. 2 & 4, the boss portion 50 is provided with a main outlet opening 48 and an auxiliary outlet opening 68. The boss portion 50 is shown having an auxiliary outlet tube 69. The boss portion 50 of the body 12 is preferably generally cylindrical for providing a pivoting mount for the swivel spout 14.

The one-piece faucet body 12 thus preferably includes an at least partially cylindrical boss portion 50 having a mounting surface 52 adapted for coupling with the cartridge 30, as well as first and second hollow leg portions 32, 34 which depend from the cylindrical portion 50. The boss portion 50 preferably includes a generally cylindrical outer wall section 70 which extends at least partially around the boss portion 50 in an area where the base sleeve 24 of the swivel spout 14 is mounted.

As shown in FIG. 6, a single handle control cartridge 30 is positioned on top of the one-piece body 12 and is adapted to allow water from the first and second inlet passages to be mixed, metered and directed in a known manner to the outlet means 44 by providing a selectable flow of hot and/or cold water. The selection of the flow rate and mix of hot and/or cold water is controlled by means of a cartridge controller 72 attached to the cartridge 30. The cartridge controller 72 also acts as a handle mount for the handle 74. The cartridge 30 is typically arranged with various chambers selectively placed in fluid communication with the inlet passages and the outlet means 44.

As best seen in FIG. 6, the lever cap 76 is adapted to fit over the cartridge housing or dome cover 18 to allow smooth relative movement between the lever cap and the cartridge housing. The lever cap 76 is secured to the cartridge controller 72 by means of a lever handle fastener 78 which, in the embodiment shown, is a set screw. The lever cap 76 is secured to the cartridge control 72 in such a manner that by controlling the lever handle 20, the lever cap 76 can be rotated or slid over the dome cover 18 thereby rotating or sliding the cartridge controller 72 and opening or shutting one or more of the cartridge chambers, thereby mixing water from either or both inlet passages and allowing water to flow through the outlet means 44.

As best seen in FIGS. 3 and 6, alignment holes 80 are shown provided in the mounting surface 52 for accommodating alignment studs that can be used to achieve proper orientation of the cartridge 30 with respect to the boss portion 50 of the manifold body 12, e.g. to achieve proper alignment between the respective inlet and outlet openings. The cartridge 30 may be provided with one or more alignment studs, or the studs may be separate pieces which are inserted into the bottom of the cartridge.

Attachment openings 82 may be provided in the mounting surface 52 of the one-piece body 12. The attachment openings 82 may be threaded and adapted to matingly engage with cartridge screws 83 for affixing the cartridge 30 to the one-piece body 12. One or more cartridge screws 83 may also perform the function of aligning the cartridge 30 with the boss 50, either in addition to or in place of the above-mentioned alignment studs.

Figure 7:
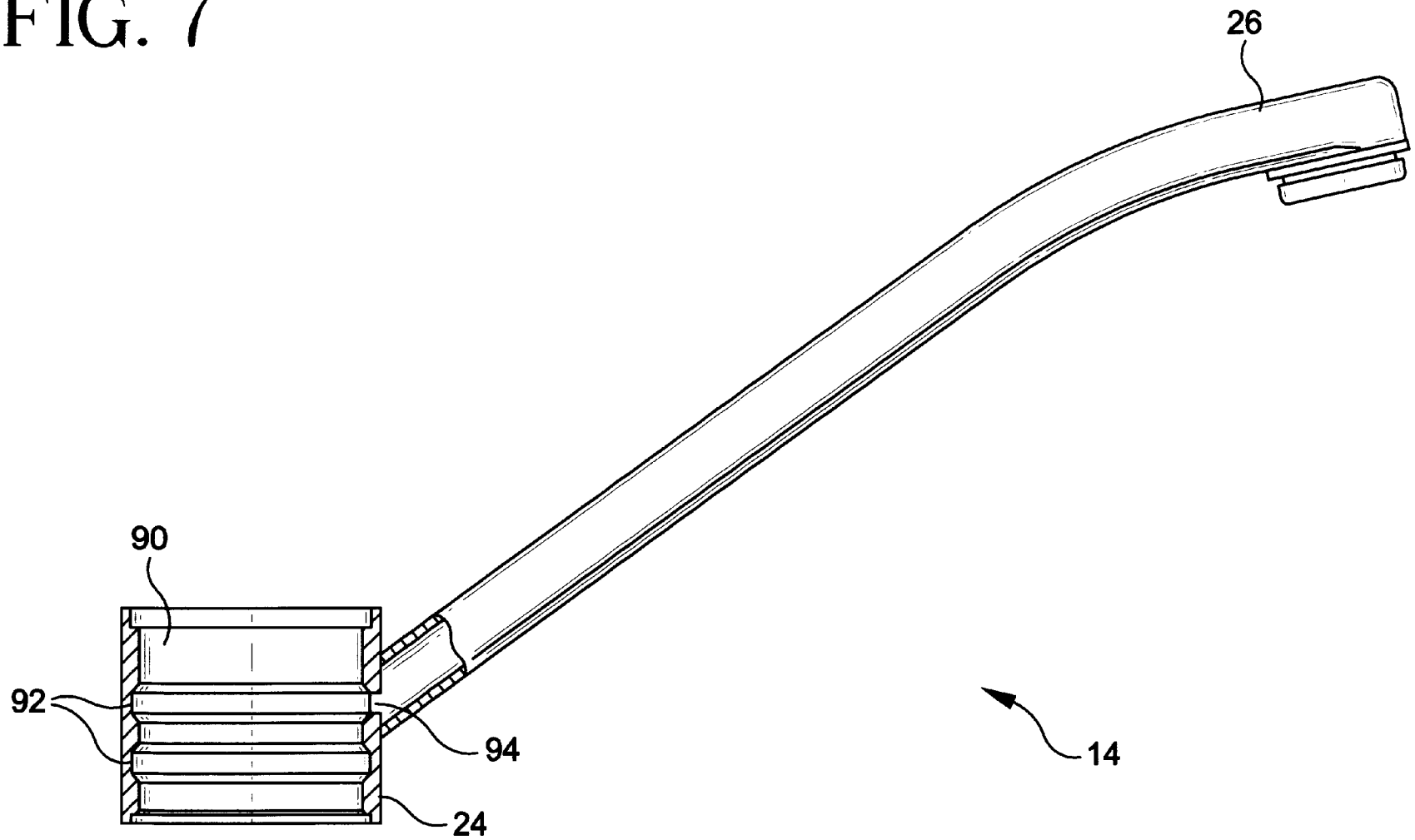
FIG. 7 is a side elevational view of the spout of FIG. 1 shown partially in cross-section.

As illustrated in FIG. 7, the swivel spout 14 has a sleeve-like base portion 24 and a conduit portion or spout arm 26 extending therefrom. The base sleeve 24 of the swivel spout 14 is provided with at least one outlet opening 94. The sleeve 24 is pivotably mounted on the body 12 over the main exit 48.

The conduit 26 depends from the base sleeve 24 and is in fluid communication with the outlet opening 94 in the base sleeve 24.

As seen in FIG. 7, the inner cylindrical surface 90 of the sleeve base 24 may be optionally provided with one or more circumferential recesses 92 to aid in the distribution of fluid circumferentially around the inner surface of the spout base 24. The spout base 24 shown in FIG. 7 has two circumferential recesses 92, wherein the upper recess intersects with the outlet opening in the base 24 when mounted thereon. It should be noted that other embodiments of the sleeve base 24 could be constructed which do not include such circumferential recesses for aiding in fluid propagation around the boss portion 50 of the one-piece manifold body 12, as further discussed below.

Referring again to FIGS. 2 & 4, at least a part of the exterior of the boss 50 which is surrounded by the sleeve base 24 is provided with a recess 100 for allowing fluid which flows from the (main) exit 48 of the outlet passage 46 in the boss 50 to travel between the exterior of the boss 50 and the sleeve base 24 thereby defining a primary outlet flow path whereby fluid may flow out of the outlet passage 46, around the exterior of the boss 50, through the outlet opening 94 of the sleeve base 24 and into the outlet conduit 26.

As shown in FIG. 6, a sealing means 102 is disposed between the base sleeve 24 and the body 12 for preventing leakage in an axial direction. As seen in FIGS. 2 & 4, the distal end 56 of the boss 50 is provided with a circumferential recess 104 which accommodates an O-ring 106. Similarly, the base 54 of the boss 50 is provided with a circumferential recess 108 which accommodates an O-ring 110.

As perhaps best illustrated in FIG. 4, the outlet passage 46 of the outlet means 44 further includes an auxiliary outlet passage or auxiliary path or auxiliary branch 112 disposed in the body 12 which opens to the exterior of the body 12 at an auxiliary exit 114. The auxiliary exit 114 is located away from the main exit 48 of the outlet passage 46.

As seen in FIG. 6, the faucet 10 further comprises means 116 for selectively diverting fluid flow into the auxiliary branch 112. Preferably, the means 116 comprises a diverter valve 118 disposed in the body 12 for selectively directing flow either to the main exit 48 or the auxiliary exit 114. As shown in FIGS. 4 & 6, the cylindrical boss portion 50 is adapted to accommodate a diverter valve 118 within the outlet passage 46. A diverter valve such as those described in U.S. Pat. Nos. 3,376,884, 4,008,732, 4,609,006, or 4,989,640 may be used. The body 12 can be adapted to accommodate a particular diverter valve, and the characteristics or construction of a particular diverter valve itself does not form part of this invention.

As mentioned above and as illustrated in FIG. 1, the faucet may preferably include an auxiliary means for conducting flow, such as a handspray 22 connected to the auxiliary branch 112.

As best seen in FIGS. 3–5, the one-piece faucet body 12 further comprises escutcheon mounting means 120 disposed on at least one of the legs 32, 34. The escutcheon mounting means 120 shown comprises ears 122 disposed on each of the legs 32, 34 wherein fasteners such as the screws illustrated in FIG. 5 can connect the escutcheon 16 to the ears 122. Thus, the escutcheon mounting means 120 includes an escutcheon mounting portion of the body 12 for allowing the attachment of the escutcheon 16 directly to the body 12. An escutcheon 16 may cover at least a part of the one-piece body 12.

As seen in FIGS. 5 and 6, a putty plate 124 is preferably interposed between the escutcheon 16 and the sink deck, wherein the putty plate 124 may be advantageously formed to be in mating relationship to both. The putty plate 124 may preferably be formed from a resilient material, such as plastic. The putty plate 124 may form a substantially closed chamber generally enclosing the internal plumbing components. Thus, the putty plate may form a seal around the internal plumbing components of the faucet. The first and second legs 32, 34 of the one-piece manifold body 12 can extend through apertures in the putty plate 124, wherein the apertures would correspond to mounting holes in the sink deck.

To install the faucet fixture 10 on the sink deck, the putty plate 124 is positioned on the one-piece body 12 so as to align the putty plate apertures to allow the first and second leg portions 32, 34 to extend therethrough and through the mounting holes of the sink deck. In a preferred embodiment, the putty plate 124 is attached to the body 12. The one-piece body 12 and the putty plate 124 are secured to the sink deck by screw mounting nuts 38 to the threads formed on the outer surface of the first and second legs 32, 34 under the sink deck. If the putty plate 124 is not attached to the body 12, the mounting nuts 38 are preferably not tightened all the way against the sink deck at first thus allowing some play in the relative positions of the putty plate 124 and the one-piece body 12. Once all of the components of the fixture are properly aligned, the mounting nuts 38 can be tightened to the sink deck, thus fixing in place the putty plate 124 and the one-piece body 12.

As shown in FIG. 6, a retainer ring 130 is disposed between the cartridge and the boss portion 50 of the one-piece body 12. The retainer ring 130 serves as a secure mount for the cartridge 30. For example, a portion of the ring 130 preferably surrounds at least a portion of the cartridge 30.

A preferred embodiment of the ring 130 is shown in FIGS. 8–12.

The ring 130 is shown in FIGS. 8–12 with interior flanges 132 which can rest on the mounting surface 52 of the boss portion 50, and on which the cartridge 30 can rest. The interior flanges 132 are preferably provided with openings 134, such as holes, or cutouts as illustrated in FIGS. 8,10,11 & 12, which can accommodate fasteners, such as bolts, screws, pins, etc., which can align and couple the cartridge 30 to the one-piece portion 12. The ring 130 also has an annular wall or outer cylindrical wall 136 with raised portions 138 which enable the dome cover 18 to be slid over, yet attached in a snug, interference friction fit connection wherein the dome cover 18 is easily assembled and subsequently removed, for example for maintenance purposes. The raised portions 138 preferably have a truncated proximal end 139. Also, the raised portions 138 preferably have a sloped, or beveled, or rounded, or otherwise contoured distal end 140 to facilitate the slide-mounting of the dome cover 18.

Figure 8:
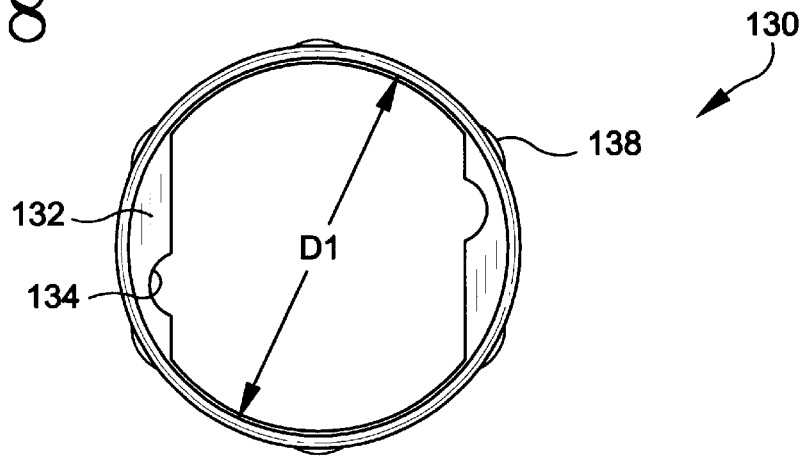
FIG. 8 is a top view of a preferred embodiment of a retainer ring according to the present invention.
Figure 9:
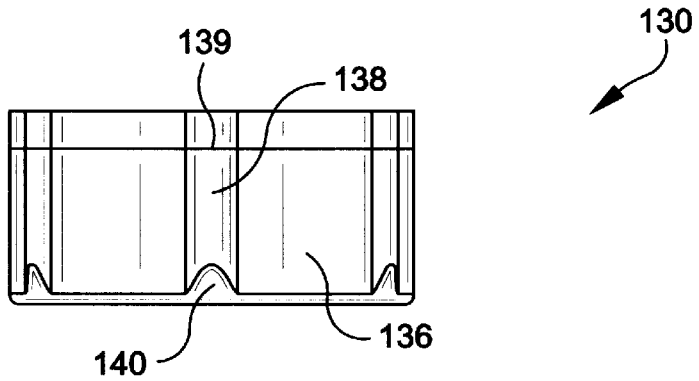
FIG. 9 is a side view of the retainer ring of FIG. 8.
Figure 10:
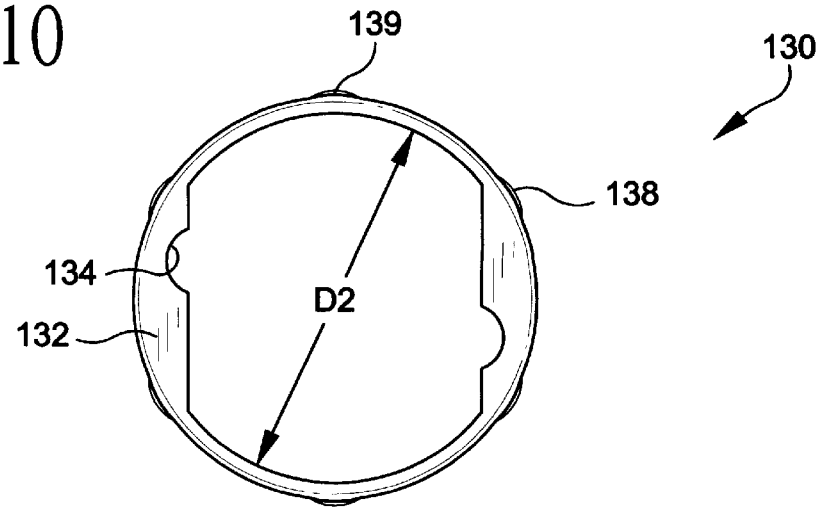
FIG. 10 is a bottom view of the retainer ring of FIG. 8.
Figure 11:
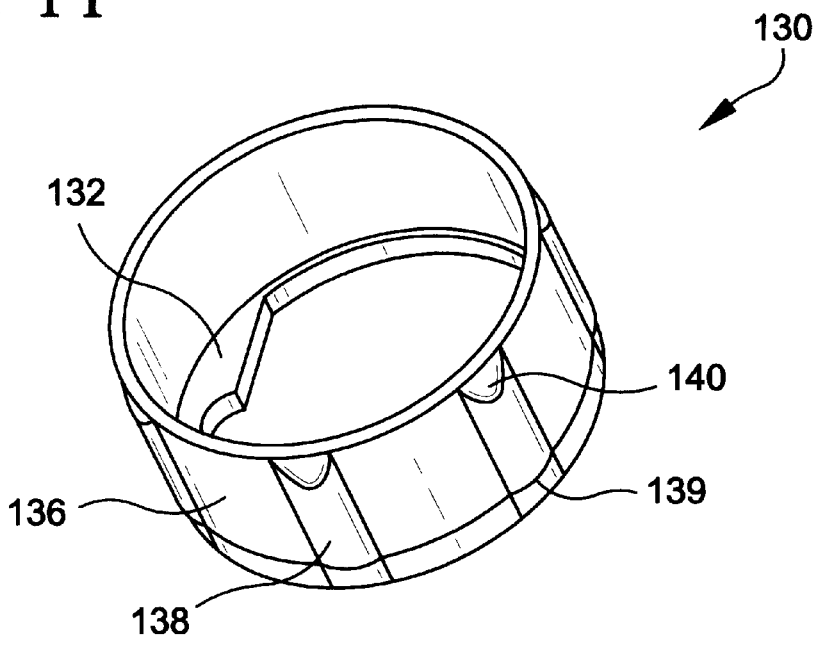
FIG. 11 is a top perspective view of the retainer ring of FIG. 8.
Figure 12:
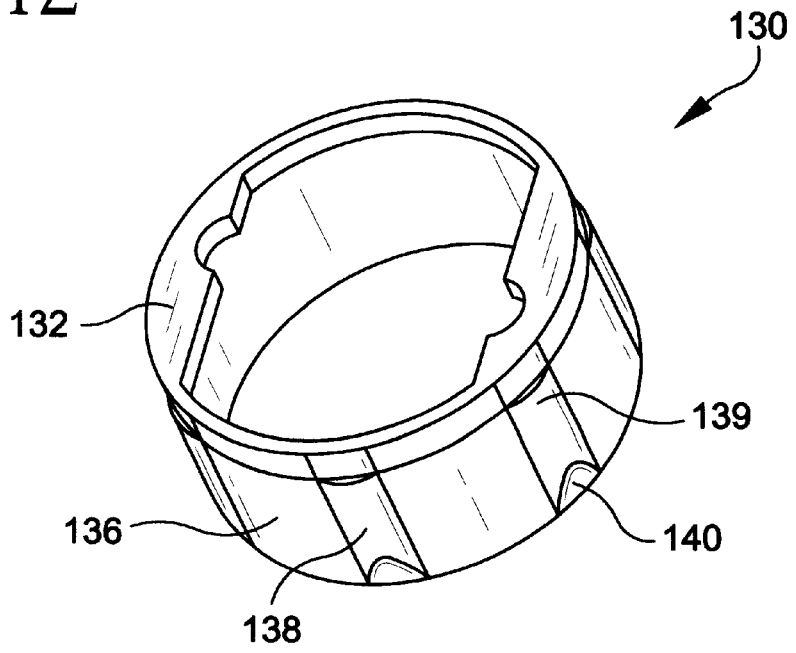
FIG. 12 is a bottom perspective view of the retainer ring of FIG. 8.

As seen in FIG. 8, a first inner diameter of the ring 130, located above the interior flange 132, is large enough to provide a clearance between the retainer ring 130 and the cartridge 30 so that the ring 130 fits around the cartridge 30. The ring 130 thus preferably helps to provide support against unwanted movement of the cartridge assembly, for example by various torques generated by actuation of the handle, and the first inner diameter of the ring 130 should also be wide enough to allow assembly of the cartridge 30 and the ring 130. As seen in FIG. 10, a second inner diameter of the ring 130, located proximate the interior flange 132, is adapted to similarly fit around the distal end 56 of the boss portion 50. As seen in FIGS. 2 and 3, the mounting surface at the distal end 56 of the boss 50 is preferably provided with a shoulder 141 corresponding to each flange 132, wherein each flange 132 rests within a respective recess defined by its corresponding shoulder 141, thereby assisting in aligning the cartridge 30 and the boss 50, and further assisting in preventing unwanted rotation therebetween.

The retainer ring 130 may thus perform several functions. The retainer ring 130 can assist in guiding or aligning the various interconnecting parts of the faucet 10 during assembly thereof. The retainer ring 130 also serves as a bearing for the spout 14, i.e. between the distal end 56 of the boss 50 and the spout sleeve 24, thereby minimizing clearance therebetween and resultant unwanted spout movement, such as rocking up and down. The ring 130 also serves as a mount for retaining or holding the cover 18.

Preferably, as seen in FIGS. 8–12, the truncated proximal ends 139 of the raised portions 138 of the retainer ring 130 form an outside lower shoulder which mates with a corresponding shoulder disposed at the top of the spout sleeve 24, thereby preventing relative axial movement therebetween; thus, when the faucet 10 is assembled and the cartridge 30 and ring 130 are fastened to the boss 50 by a fastener (or fasteners) such as screw 83, the spout sleeve 24 can not slide axially upward toward the cartridge area; in other words, the spout 14 is axially locked but can rotate or pivot about boss or cylinder 50. Therefore, the retainer ring 130 preferably serves as a stop wherein the ring 130 is disposed between the cartridge 30 and boss 50 and mounts the spout base 24 to the body 12 so as to allow rotational movement but which minimizes axial movement, thereby helping to prevent leakage between the spout 14 and the body 12. The retainer ring 130 can also be advantageously formed to allow a close fit with the boss 50, cartridge 30, spout base 24, and dome cover 18, thereby permitting the overall dimensions of the faucet to be minimized or optimized.

The faucet 10 may further preferably include a lower bearing means 142 which may comprise an annular recess disposed around the interior of the spout base 24 and a lower bearing ring disposed therein such that the lower bearing ring reduces friction during relative movement between the spout base 24 and the base 54 of the boss 50, such as when the spout 14 is rotated about its axial pivot axis. As seen in FIG. 6, the recess is preferably formed by a downward-facing shoulder disposed on the bottom of the spout base 24, whereby the lower bearing ring reduces frictional drag between the spout base 24 and the escutcheon 16 as well as the base 54.

Reference is now made to FIGS. 13–16 which depict another preferred embodiment of a one-piece body 212 according to the present invention. Elements of this second preferred embodiment are labeled in the FIGS. consistently with corresponding elements in the first preferred embodiment.

Figure 14:
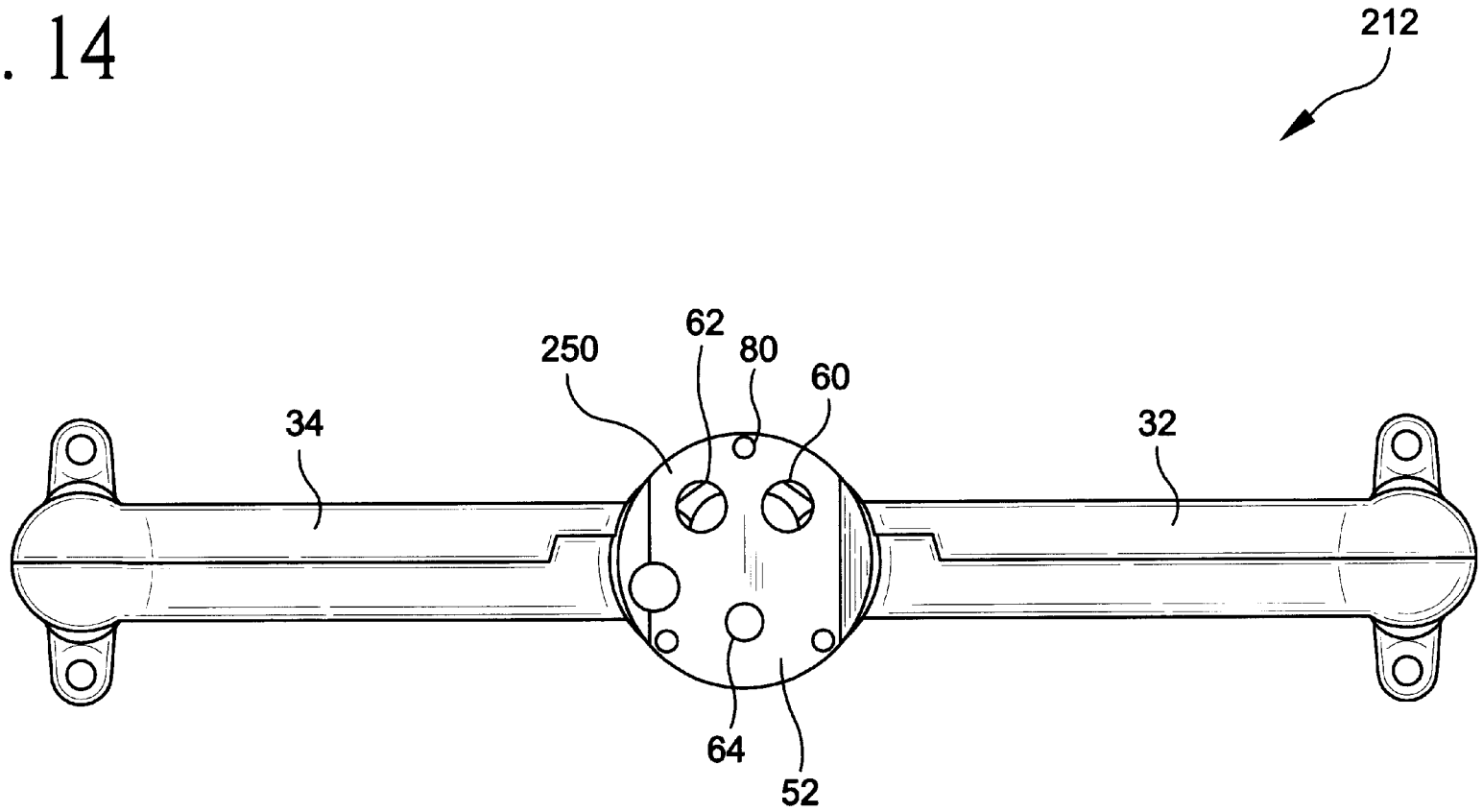
FIG. 14 is a top view of the one-piece manifold body in accordance with the one-piece manifold body of FIG. 13.
Figure 15:
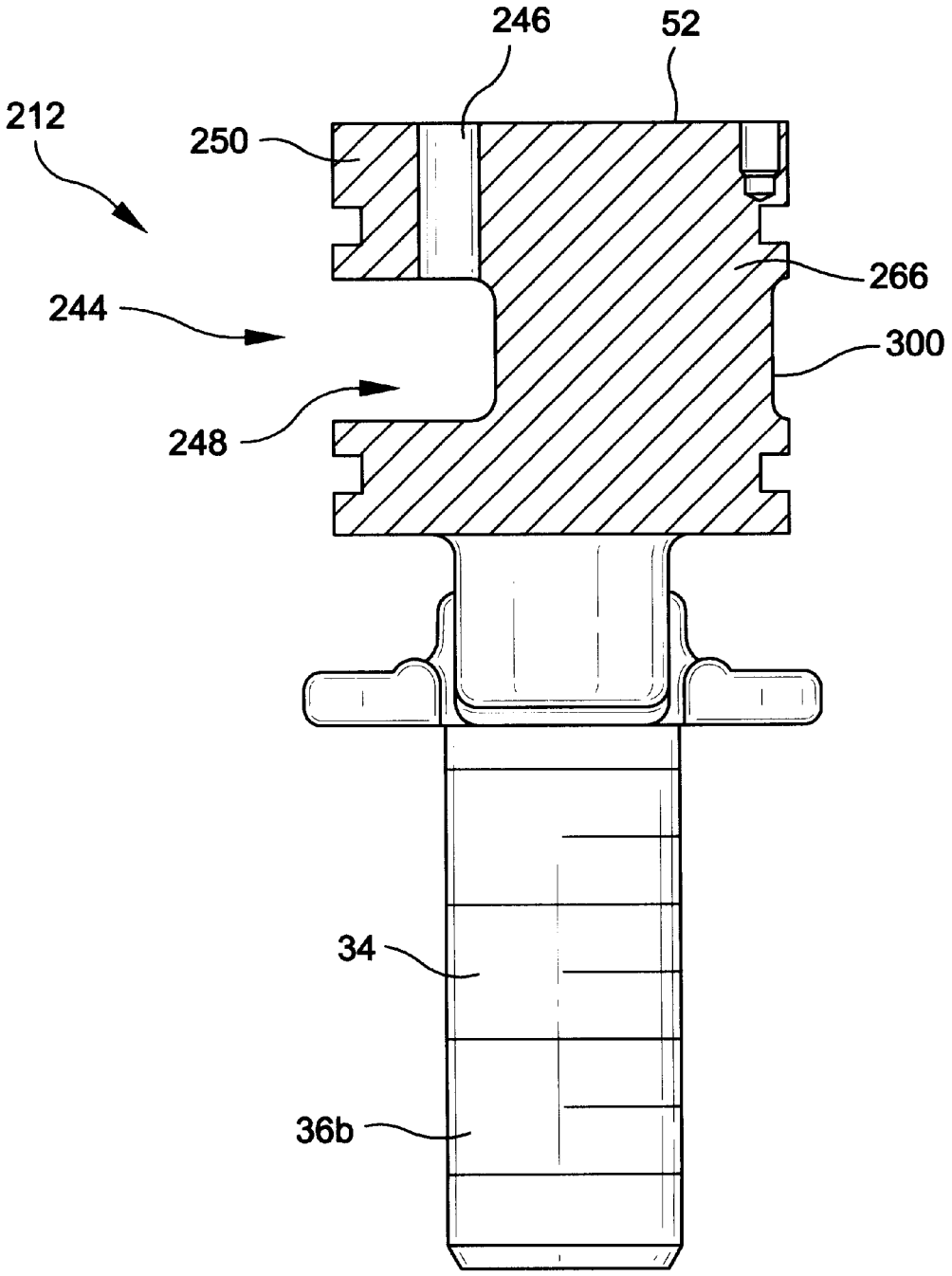
FIG. 15 is a side elevational cross-sectional view of the one-piece manifold body of FIG. 13 taken along line 15—15.

The one-piece manifold body 212 has first and second inlet passages and an outlet means 244, including an outlet passage 246 which opens to the exterior of the body 212 at an exit 248, as seen, for example, in FIG. 15. As seen in FIGS. 13–16, the one-piece body 212 includes a boss 250 having a mounting surface 52 adapted for coupling to the cartridge 30. The one-piece body 212 also has a first chamber which is open to the interior of the first hollow leg 32 and to one of the inlet openings of the cartridge 30. The one-piece manifold body 212 also has a second chamber which is open to the interior of the second hollow leg 34 and to the other inlet opening of the cartridge 30.

The outlet means 244, which includes the outlet passage 246, is provided in the one-piece body 212 for fluidly connecting the outlet opening of the cartridge 30 with the exterior of the faucet body 212 at an exit which is remote from the mounting surface 52.

Figure 13:
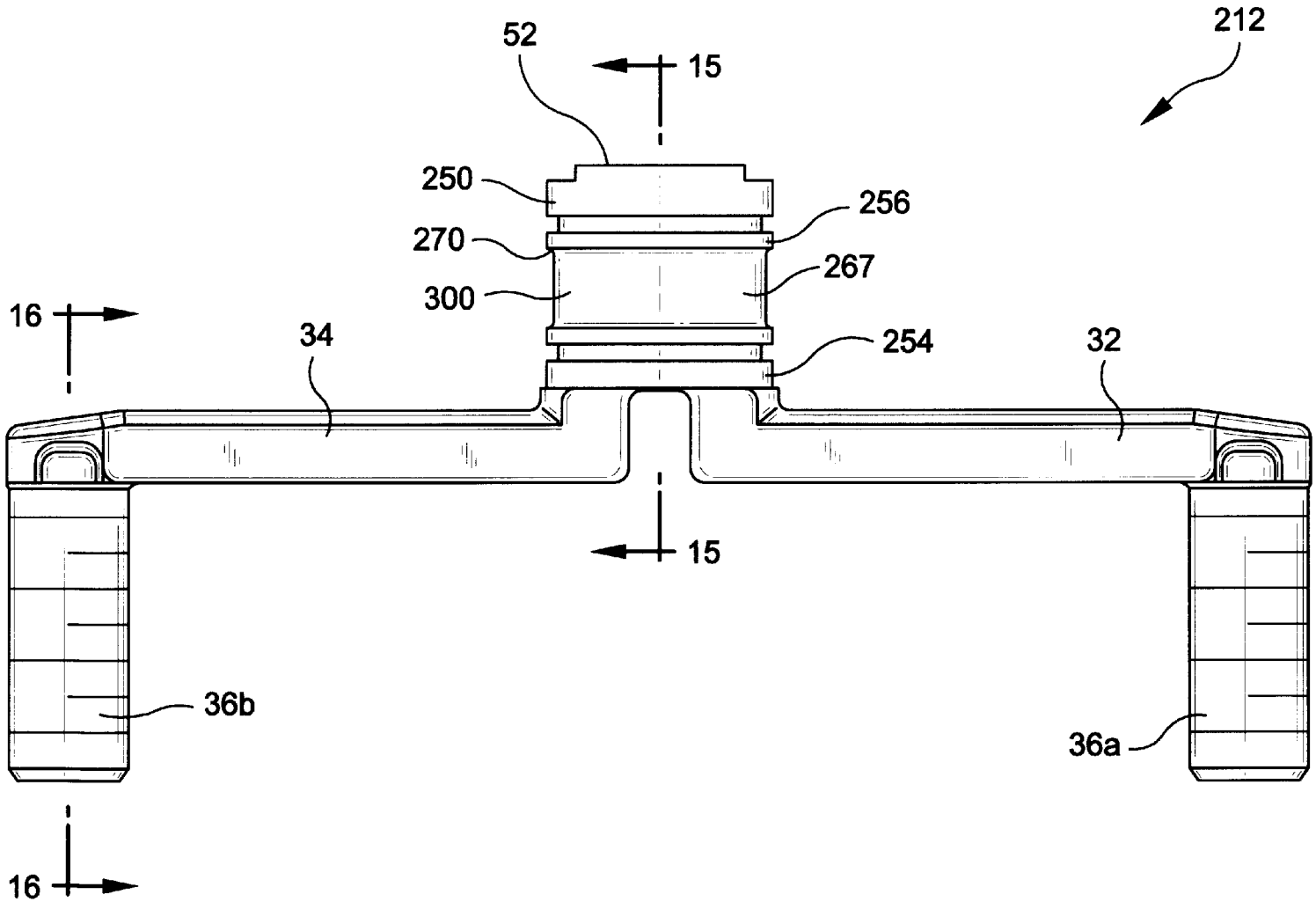
FIG. 13 is a front elevational view of a one-piece manifold body in accordance with a second preferred embodiment of the present invention.

As best seen in FIGS. 13 and 14, the boss 250 has a base section 254, which has first and second inlet passage inlet-openings, and a distal section 256, which has first and second inlet passage outlet-openings 60, 62. The distal section 256 also has a third opening or an outlet passage inlet-opening 64.

In the embodiment illustrated in FIG. 15, the boss 250 has an interior wall 266 which separates an interior cavity into the first and second inlet chambers. The first and second inlet passage inlet-openings in the base 254 are positioned in fluid communication with the respective first and second inlet chambers, and the first and second inlet passage outlet-openings 60, 62 in the distal end 256 are likewise positioned in fluid communication with respective first and second inlet chambers. The outlet means 244 is disposed between the base 254 and distal end 256 and intersects the interior wall 266.

Figure 16:
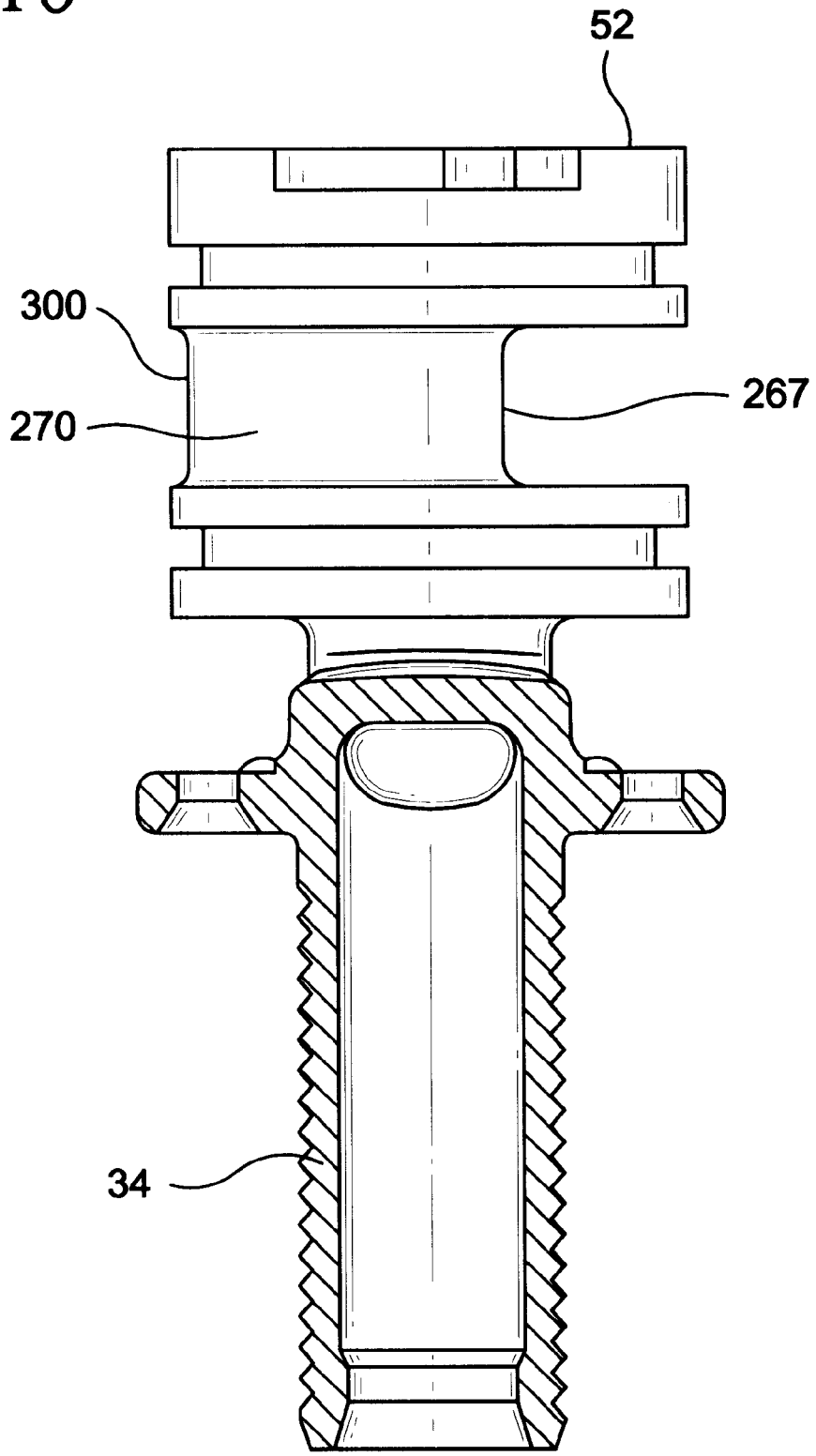
FIG. 16 is a side elevational cross-sectional view of the one-piece manifold body of FIG. 13 taken along line 16—16.

As shown in FIGS. 14 and 16, the second preferred embodiment of the body 212 includes a transverse wall 267 which intersects the interior wall 266. The transverse wall 267 joins the outer wall 270 of the boss 250 to form part of the exterior of the base 254.

As seen in FIGS. 13–16, the boss portion 250 of the body 212 is preferably generally cylindrical for providing a pivoting mount for a swivel spout 14.

As seen in FIGS. 15 and 16, at least a part of the exterior of the boss 250 which is surrounded by the sleeve base is provided with a recess 300 for allowing fluid which flows from the (main) exit of the outlet passage in the boss 250 to travel between the exterior of the boss 250 and the sleeve base 24, thereby defining a primary outlet flow path whereby fluid may flow out of the outlet passage, around the exterior of the boss 250, through the outlet opening of the sleeve base and into the outlet conduit.

A sealing means 102 is preferably disposed between the base sleeve 24 and the body 212 for preventing leakage in an axial direction. As seen in FIGS. 13,15 and 16, the distal end 256 of the boss 250 is provided with a circumferential recess 104 which accommodates an O-ring 106. Similarly, the base 254 of the boss 250 is provided with a circumferential recess 108 which accommodates an O-ring 110.

As in the first preferred embodiment described above, a retainer ring 130 may be advantageously disposed between the cartridge 30 and the boss portion 250 of the one-piece body 212.

Reference is now made to FIGS. 17–23 which depict a third preferred embodiment of a faucet 410 comprising a one-piece body 412 according to the present invention. Elements of this third preferred embodiment are labeled in the Figures consistently with corresponding elements in the first preferred embodiment.

Figure 17:
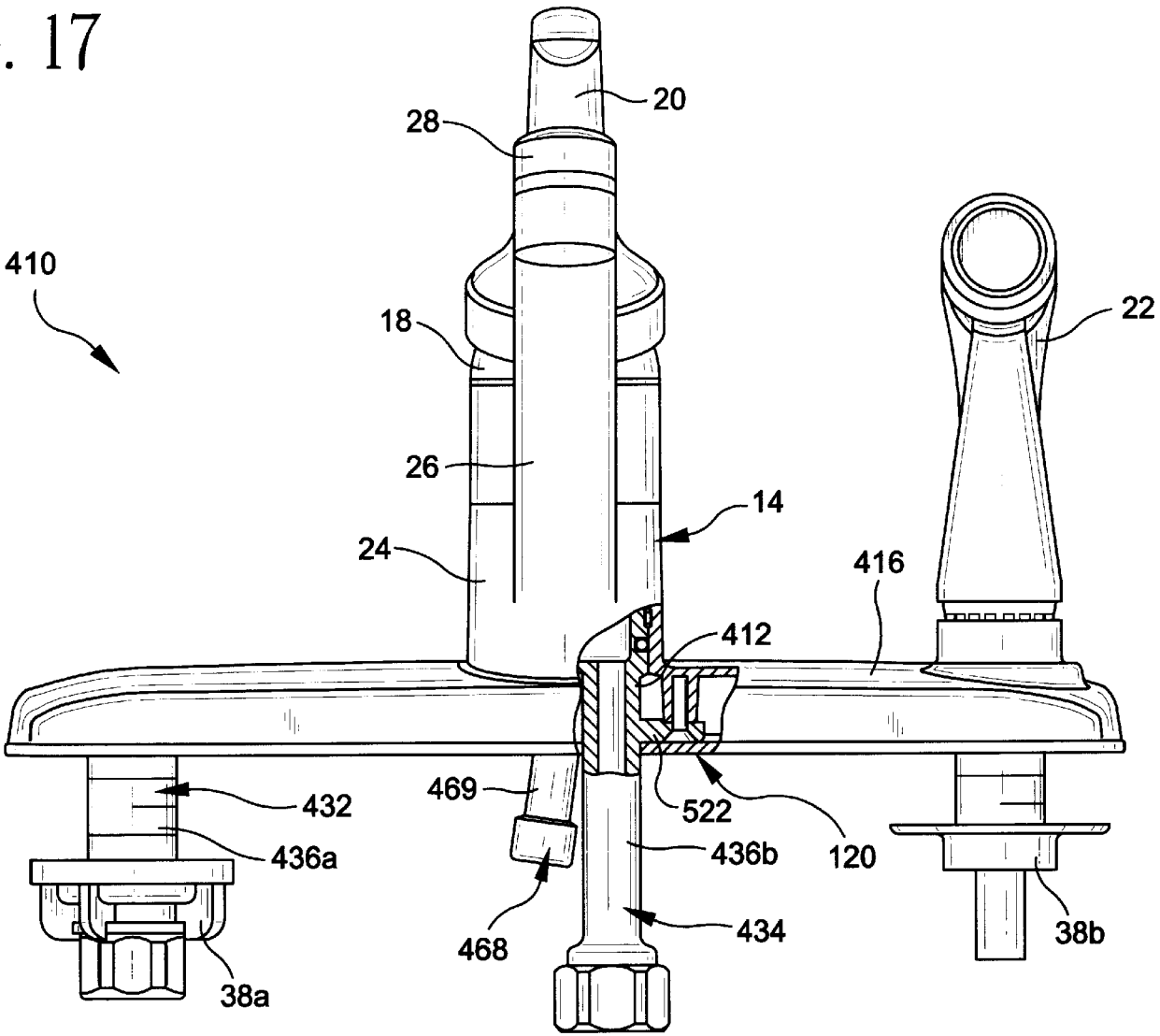
FIG. 17 is a front elevational view with partial cutaway of a faucet with a handspray attachment, in accordance with a third preferred embodiment of the present invention.
Figure 18:
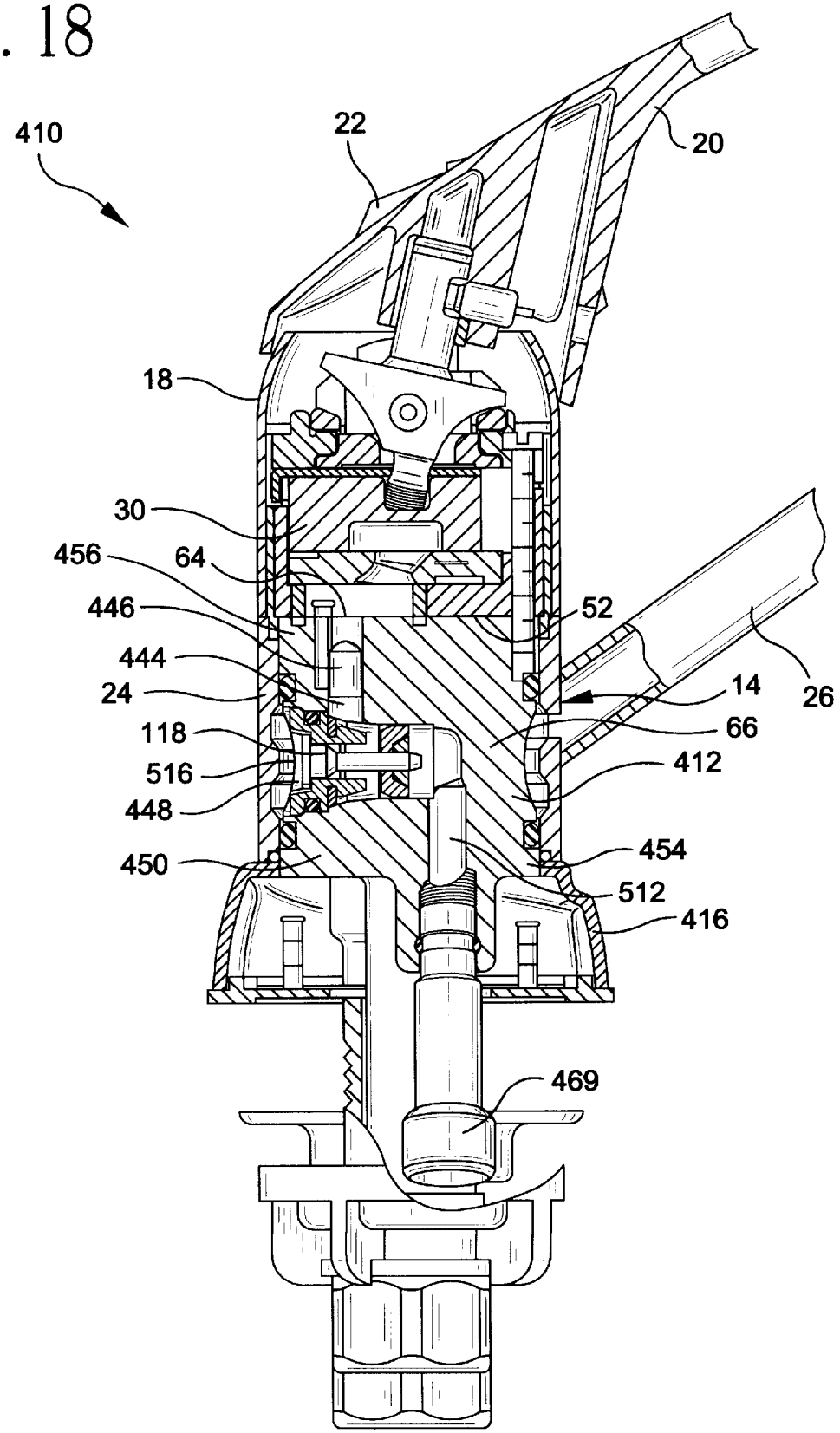
FIG. 18 is a side elevational partially cross-sectioned view of the faucet of FIG. 17 taken along line 17—17.
Figure 19:
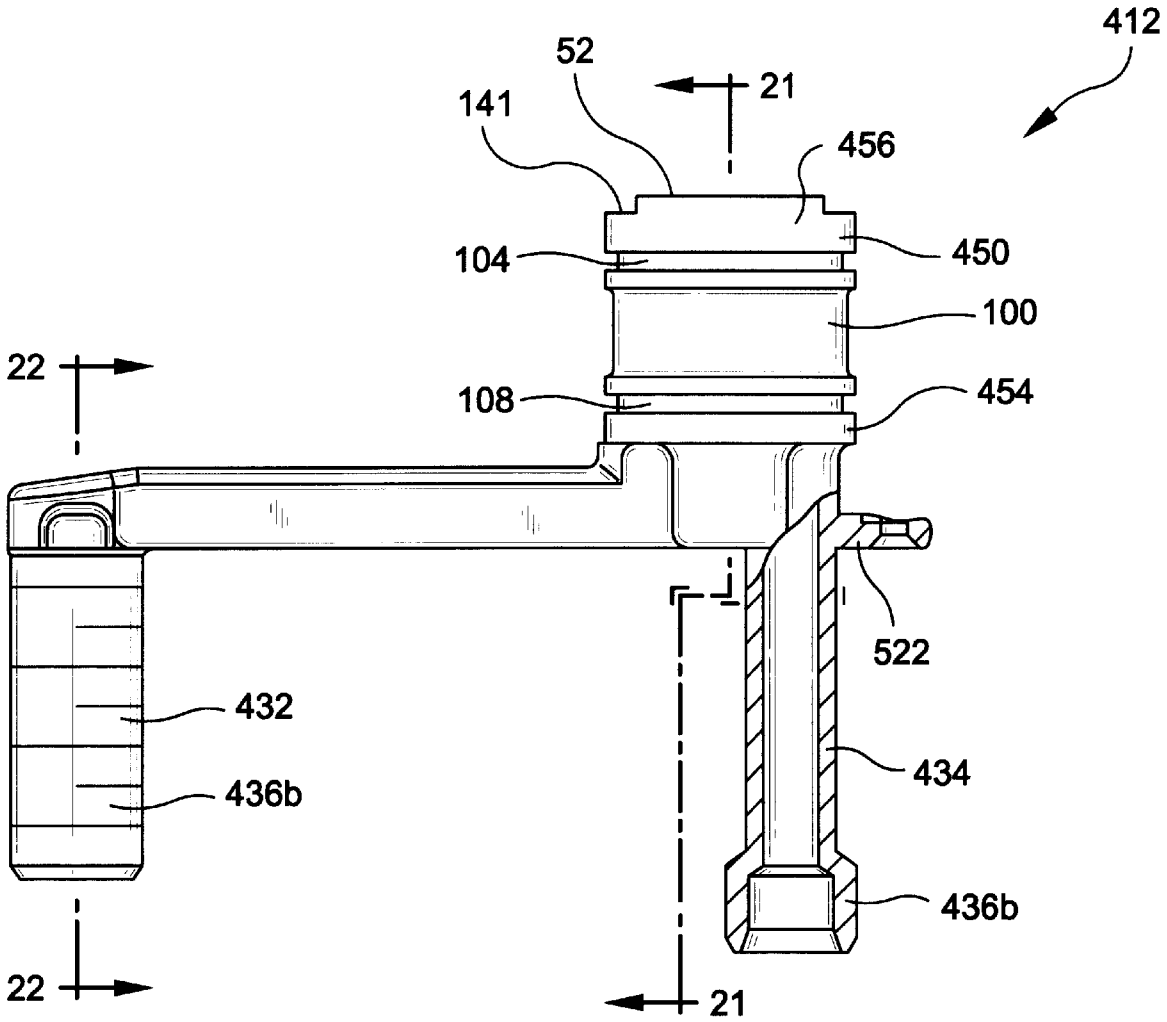
FIG. 19 is a front elevational partially cross-sectioned view of the one-piece manifold body of the faucet of FIG. 17.
Figure 20:
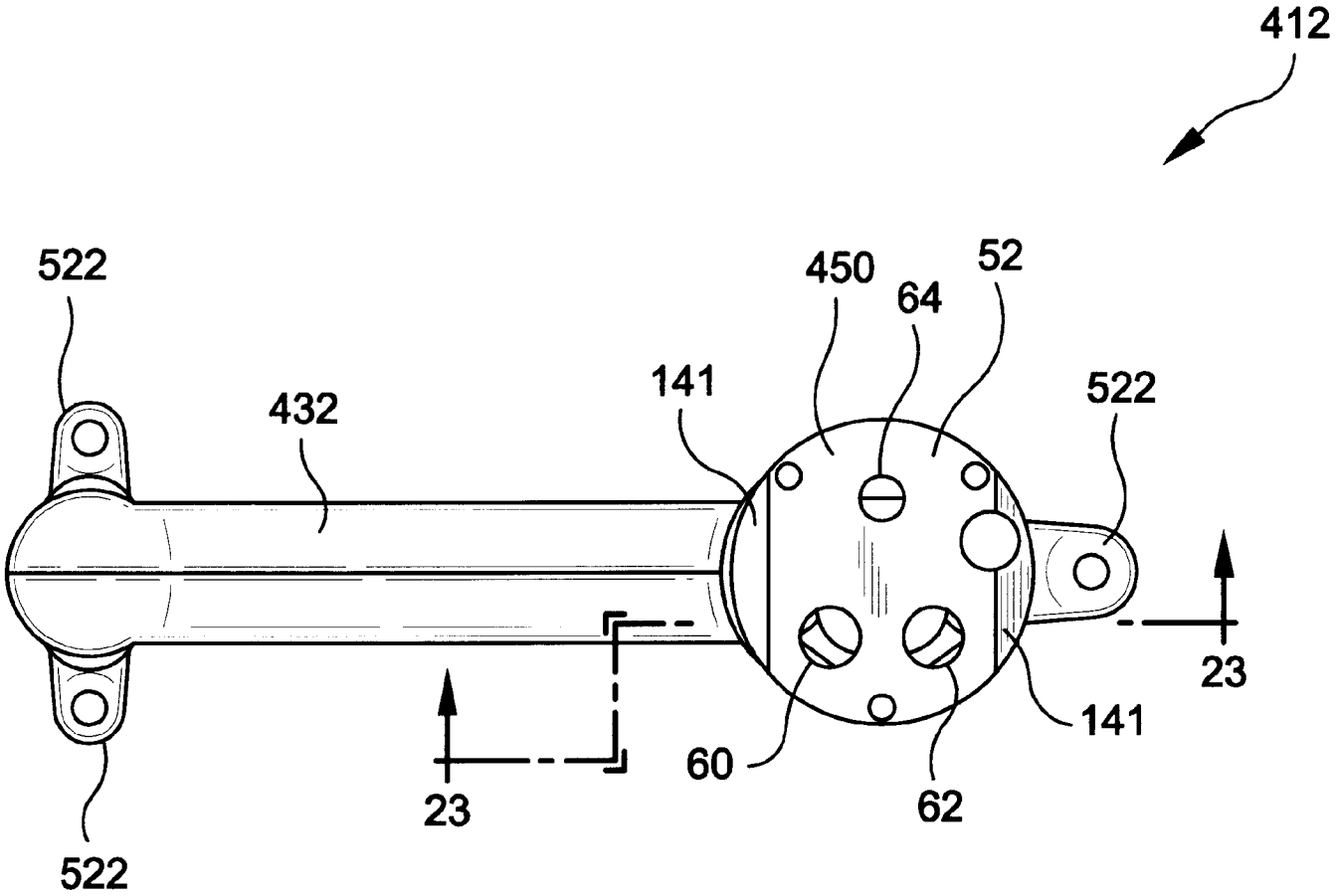
FIG. 20 is a top view of the one-piece manifold body of the faucet of FIG. 17.
Figure 21:
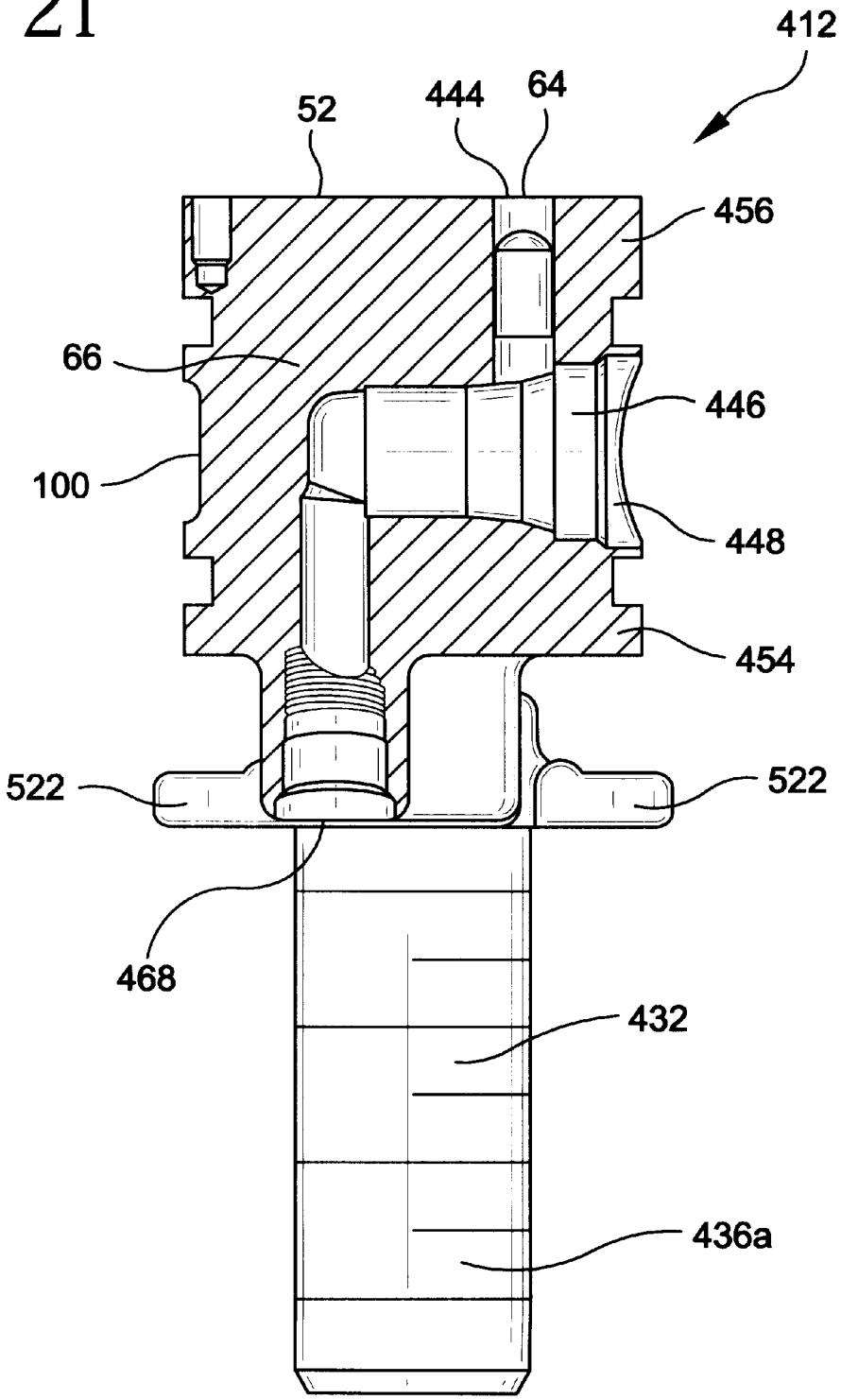
FIG. 21 is a side elevational cross-sectional view of the one-piece manifold body of FIG. 19 taken along line 21—21.
Figure 22:
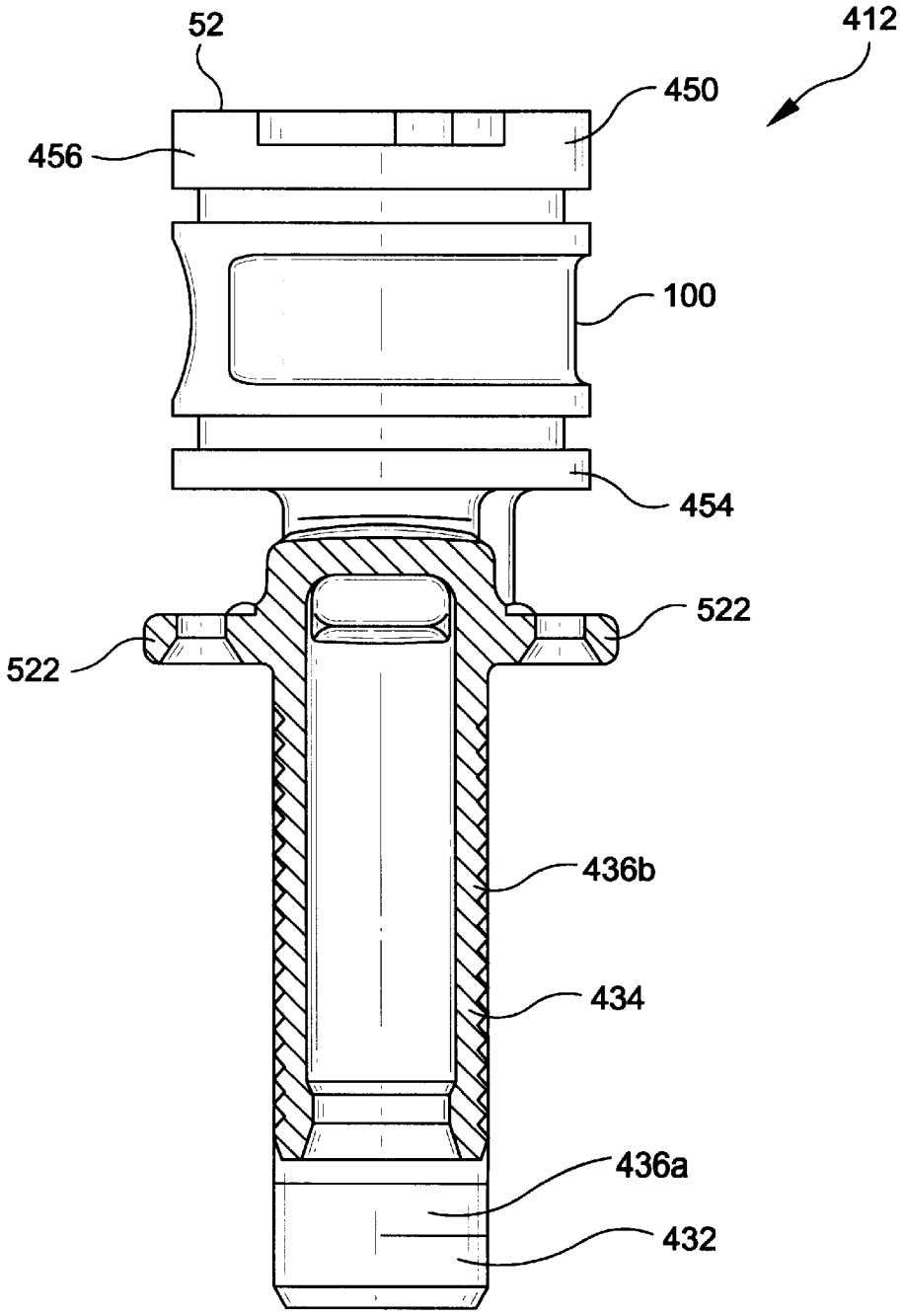
FIG. 22 is a side elevational cross-sectional view of the one-piece manifold body of FIG. 19 taken along line 22—22.
Figure 23:
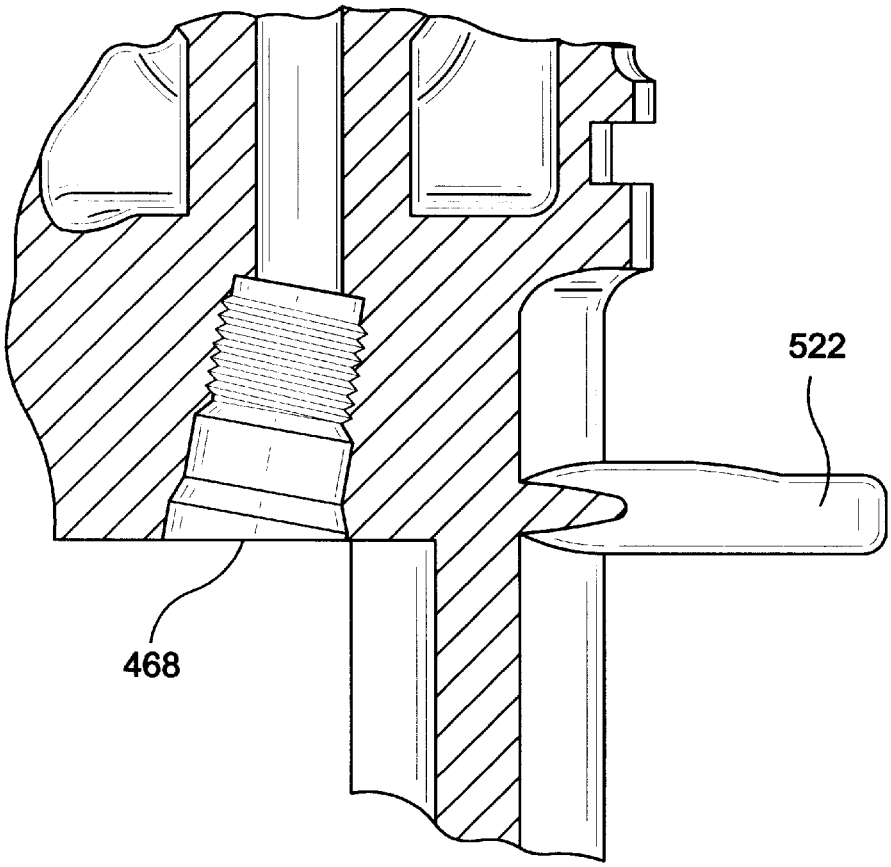
FIG. 23 is a partially cutaway view of the one-piece manifold body of the faucet of FIG. 20 taken along line 23—23.

As seen in FIGS. 17–18, the faucet 410 of the present invention comprises a one-piece manifold body 412 and a swivel spout 14. The faucet fixture 410 includes an escutcheon 416, a dome cover 18, a handle 20, and a handspray 22. The escutcheon 416 is preferably fixed to the unitarily constructed internal waterway or one-piece body 412 of the faucet 410 as described more fully in detail below. The swivel spout 14 has a base sleeve 24 and a conduit 26. An aerator 28 is typically optionally fitted to the distal end of the conduit 26. As seen in FIG. 15, the faucet 410 also comprises a cartridge 30. The cartridge 30 is typically provided with first and second inlet openings and an outlet opening.

As best seen in FIGS. 19–23, the one-piece faucet body 412 has a first hollow leg portion 432 and a second hollow leg portion 434. The first leg 432 can be connected to a first fluid conduit, and the second leg 434 can be connected to a second fluid conduit, wherein the conduit may be a pipe, a tube, a hose, or the like. A first inlet passage begins at the entrance to the first leg portion 432 and a second inlet passage begins at the entrance to the second leg portion 434.

The first and second hollow legs 432, 434 each preferably include a shank section 436*a*, 436*b* which enables a direct physical connection to the fluid source conduits. Thus, the first shank section 436*a* has a bore which forms at least part of the first inlet passage, and the second shank section 436*b* has a bore which forms at least part of the second inlet passage. The shank sections 436*a*, 436*b* may be further adapted to facilitate connection with the supply conduit, such as by threading. Thus, the body 412 can be mounted directly to a supporting or rigid supply conduit, thereby obviating another separate physical connection between the body and the supporting structure as would be found in existing faucets. The body 412 as well as the entire faucet 410 of the present invention can be mounted to the supporting supply pipes.

Referring back to FIG. 17, the escutcheon 416 is mounted to a truncated manifold body 412 as seen by the partial cutaway view. The escutcheon 416 is provided with a throughbore in one of its sides. The throughbore accommodates a tubular support for supporting the handspray 22 and/or the supply tubing of the handspray. The tubular support is adapted to receive a mounting nut for securing the faucet 410 to the sink deck.

FIGS. 17–18 show the one-piece body 412 assembled to be fixed to a sink deck by a mounting nuts 38*a*, 38*b* which engage an external surface of the first leg 432 and the tubular support, respectively.

As best seen in FIGS. 19–23, the one-piece manifold body 412 has first and second inlet passages and an outlet means 444 having at least one outlet passage, including a main outlet passage 446 which opens to the exterior of the body 412 at a main exit 448.

The outlet means 444, which includes the main outlet passage 446, is provided in the one-piece body 412 for fluidly connecting the outlet opening of the cartridge 30 with the exterior of the faucet body 12 at a main exit 448 which is remote from the mounting surface 52. The boss 450 has a base section 454, which has first and second inlet passage inlet-openings, and a distal section 456, which has first and second inlet passage outlet-openings. The distal section 456 also has a third opening or an outlet passage inlet-opening 64. An interior wall 66 separates an interior cavity into the first and second inlet chambers. The first and second inlet passage inlet-openings in the base are positioned in fluid communication with the respective first and second inlet chambers, and the first and second inlet passage outlet-openings 60, 62 in the distal end 456 are likewise positioned in fluid communication with respective first and second inlet chambers. The outlet means 444 is disposed between the base 454 and distal end 456 and intersects the interior wall 66.

The boss portion 450 is provided with a main outlet opening 448 and an auxiliary outlet opening 468. In the third preferred embodiment, the boss portion 450 includes an auxiliary outlet tube 469 which depends downwardly at an angle offset from vertical. Such a configuration is advantageous for connection to an auxiliary handspray connector or tubing, given the closer proximity of the second leg 434, as compared to, for example, the positions of the legs 32, 34 of the first preferred embodiment. Other embodiments of the present invention may utilize an auxiliary outlet tube which is not offset at an angle. The auxiliary outlet tube 469 is preferably formed integrally with the remainder of the body 412. As an alternative, a separate tube may be attached to an auxiliary branch 512 disposed in the body 412 for example by a threaded and sealed connection.

Referring to FIG. 18, the faucet 410 further comprises means 516 for selectively diverting fluid flow into the auxiliary branch 512. Preferably, the means 516 comprises a diverter valve 118 disposed in the body 412 for selectively directing flow either to the main exit 448 or the auxiliary exit 514.

As seen in FIGS. 17–23, the one-piece faucet body 412 further preferably comprises escutcheon mounting means 120. The escutcheon mounting means 120 shown comprises at least one ear 522 depending from leg 434 disposed proximate the boss portion 450 of the body 412, and preferably comprises at least one other ear 522 disposed on or near leg 432. Thus, the escutcheon mounting means 120 includes one or more escutcheon mounting portions for allowing the attachment of the escutcheon 416 directly to the body 412.

The legs 432, 434 of the third preferred embodiment are disposed asymmetrically about the swivel spout 14 or the boss portion 450 of the body 412, in contrast to the legs 32, 34 of the first and second embodiments described above which are disposed substantially symmetrically about the boss portion of those embodiments. The asymmetric placement of the legs 432, 434 of the third preferred embodiment enables the escutcheon 416 to accommodate a handspray 22 on a handspray mounting portion. Thus, as viewed by the user from above the sink deck, the faucet 410 comprises an escutcheon 416 symmetrically disposed about the spout 14, wherein the escutcheon 416 houses the handspray 22.

Thus, the faucet construction described above provides a one piece waterway construction heretofore not found. The faucet construction also allows the escutcheon body to be coupled only to the one-piece waterway or body, not to the deck itself.

The one-piece manifold body can be advantageously made, for example, from metal or plastic, and formed, for example, by casting with subsequent machining. One preferred embodiment of the present invention is formed from cast brass with subsequent machining. Other materials and methods of manufacture as known by the skilled artisan may be used to produce the present invention.

The fixture of the present invention can be used as a faucet which typically accommodates hot and cold water flow. However, such a faucet, or one-piece manifold body, can be constructed to accommodate other fluids other than water, and the present invention encompasses such applications as well.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

What is claimed is:

1. A faucet for use with a first fluid conduit and a second fluid conduit comprising:

a mixing cartridge having two inlet openings and an outlet opening;

a one-piece manifold body including:

a first hollow leg for connection with the first fluid conduit;

a second hollow leg for connection with the second fluid conduit; and a boss having:

an exterior cartridge mounting surface upon which said cartridge is disposed, an interior wall which defines first and second chambers, wherein said first chamber is open to the interior of said first hollow leg and is open to one of the inlet openings of the cartridge, and wherein said second chamber defines a second chamber which is open to the interior of said second hollow leg and which is open to the other inlet opening of the cartridge, and an outlet passage provided therethrough which fluidly connects the outlet opening of said cartridge with the exterior of said boss at a main exit which is remote from said cartridge mounting surface;

and a swivel spout pivotably mounted on said body;

whereby said first hollow leg and said first chamber define a first inlet path from the first fluid conduit to said mixing cartridge; and whereby said second hollow leg and said second chamber define a second inlet path from the first fluid conduit to said mixing cartridge, said first and second inlet paths being separate from one another.

2. The faucet according to claim 1 further comprising sink deck mounting nuts for securing said first and second hollow legs.

3. The faucet according to claim 1 further comprising an escutcheon coupled to said body.

4. The faucet according to claim 1 further comprising a retainer ring interposed between said cartridge and said body.

5. The faucet according to claim 4 wherein said retainer ring comprises:

an annular wall having a top end, a bottom end, an inner surface, and an outer surface;

at least one flange extending inwardly from said inner surface and bisecting said annular wall, thereby defining a downwardly facing cup portion and an upwardly facing cup portion, wherein said downwardly facing cup portion is adapted to engage said cartridge and said upwardly facing cup portion is adapted to engage said one-piece manifold body, whereby said at least one flange is sandwiched between said cartridge and said body.

6. The faucet according to claim 5 wherein said at least one flange comprises at least one opening.

7. The faucet according to claim 6 wherein said at least one opening comprises at least one cutout.

8. The faucet according to claim 5 wherein said outer surface of said annular wall comprises at least one raised portion.

9. The faucet according to claim 8 wherein at least one end of said at least one raised portion is contoured.

10. The faucet according to claim 1 further comprising a diverter valve disposed in said body.

11. The faucet according to claim 1 further comprising a hand spray coupled to said body.

12. The faucet according to claim 1 wherein said swivel spout comprises a base sleeve provided with a base sleeve outlet opening and pivotably mounted on said body over said main exit, and a conduit depending from said base sleeve and in fluid communication with said base sleeve outlet opening, whereby fluid may flow out of said main outlet passage and through said base sleeve and said conduit, and wherein said body further comprises a generally cylindrical outer wall around which said base sleeve is mounted.

13. The faucet according to claim 12 further comprising sealing means disposed between said base sleeve and said body for preventing leakage.

14. The faucet according to claim 1 wherein said outlet passage further includes an auxiliary outlet passage disposed in said body which opens to the exterior of said body at an auxiliary exit.

15. The faucet according to claim 14 further comprising a diverter valve disposed in said body for selectively directing flow either to said main exit or said auxiliary exit.

16. The faucet according to claim 1 wherein said first and second hollow legs are spaced substantially away from one another.

17. The faucet according to claim 1 wherein said first and second hollow legs are disposed substantially symmetrically with respect to said swivel spout.

18. The faucet according to claim 1 wherein said swivel spout comprises a sleeve base and an outlet conduit, said sleeve base having a sleeve base outlet opening to said outlet conduit, said sleeve base being pivotably mounted around said boss.

19. The fitting according to claim 18 wherein at least a part of the exterior of said boss which is surrounded by said sleeve base is provided with a recess for allowing fluid which flows from the exit of said outlet passage in said boss to travel between the exterior of said boss and said sleeve base.

* * * * *